US009315955B2

(12) United States Patent
Knapp

(10) Patent No.: US 9,315,955 B2
(45) Date of Patent: Apr. 19, 2016

(54) SAW AND DRILL MACHINE FOR PAVED SLABS

(71) Applicant: Ronald A. Knapp, Bonita Springs, FL (US)

(72) Inventor: Ronald A. Knapp, Bonita Springs, FL (US)

( * ) Notice: Subject to any disclaimer, the term of this patent is extended or adjusted under 35 U.S.C. 154(b) by 46 days.

(21) Appl. No.: 14/206,324

(22) Filed: Mar. 12, 2014

(65) Prior Publication Data

US 2014/0265526 A1 Sep. 18, 2014

Related U.S. Application Data

(60) Provisional application No. 61/780,055, filed on Mar. 13, 2013.

(51) Int. Cl.

| | |
|---|---|
| ***E01C 23/09*** | (2006.01) |
| ***E01C 19/00*** | (2006.01) |
| ***B28D 1/04*** | (2006.01) |

(52) U.S. Cl.

CPC ..... *E01C 23/0933* (2013.01); *B28D 1/045* (2013.01); *E01C 19/004* (2013.01); *E01C 23/094* (2013.01)

(58) Field of Classification Search

CPC ... E01C 23/094; E01C 23/0933; E01C 23/09; B23D 45/027; B23D 45/024; B28D 1/045; B28D 1/044; B27B 5/10; Y10T 83/7755

USPC ..... 125/13.01, 13.03, 3, 4, 5, 38

See application file for complete search history.

(56) References Cited

U.S. PATENT DOCUMENTS

| | | | | | |
|---|---|---|---|---|---|
| 1,536,178 | A | * | 5/1925 | Hackett | 299/39.3 |
| 2,311,891 | A | * | 2/1943 | Tyson | 299/39.5 |
| 2,502,043 | A | * | 3/1950 | Howard | 299/39.3 |
| 2,744,740 | A | | 5/1956 | Ball | |
| 3,360,298 | A | * | 12/1967 | Stoljarov et al. | 299/41.1 |
| 3,649,071 | A | | 3/1972 | Graff | |
| 4,832,412 | A | | 5/1989 | Bertrand | |
| 4,889,192 | A | * | 12/1989 | Ricard | 173/185 |
| 4,900,094 | A | * | 2/1990 | Sergeant | 299/39.6 |
| 4,968,099 | A | * | 11/1990 | Meister | 299/1.5 |
| 5,529,735 | A | * | 6/1996 | Durham | 264/154 |
| 6,131,557 | A | | 10/2000 | Watson | |
| 6,464,020 | B1 | * | 10/2002 | Wills | 175/20 |
| 6,582,026 | B2 | | 6/2003 | Bertrand | |
| 6,907,874 | B1 | * | 6/2005 | Faircloth | 125/13.01 |
| 7,036,606 | B2 | * | 5/2006 | Rossi | 173/28 |
| 7,451,757 | B2 | | 11/2008 | Ketterhagen et al. | |
| 2004/0112613 | A1 | * | 6/2004 | McGivery | 172/25 |
| 2006/0189258 | A1 | * | 8/2006 | Schaer et al. | 451/5 |
| 2011/0155114 | A1 | | 6/2011 | Bockes et al. | |
| 2011/0203565 | A1 | | 8/2011 | Hilsgen et al. | |

* cited by examiner

*Primary Examiner* — John Kreck
*Assistant Examiner* — Carib Oquendo
(74) *Attorney, Agent, or Firm* — Erickson Kernell Derusseau & Kleypas, LLC

(57) ABSTRACT

A machine for making cuts through and boring holes into a paved slab includes a pair of saw guide tracks with circular saws mounted thereon for linear movement in parallel spaced relationship. The tracks and saws are mounted on a laterally expandable support frame which is rotatably suspended from a main frame for adjusting the spacing between cuts. The saw guide tracks are suspended from the laterally expandable saw and track support frame by vertically telescoping legs operable to raise and lower the guide tracks and saws supported thereon relative to the paved slab. Drills are mounted on a drill support assembly that telescopes laterally and vertically and which is rotatable about a vertical axis to permit adjustment to the positioning of the drills for boring holes in the slab.

22 Claims, 20 Drawing Sheets

SAW AND DRILL MACHINE FOR PAVED SLABS

CROSS-REFERENCE TO RELATED APPLICATIONS

This application claims priority from U.S. Provisional Patent Application No. 61/780,055 filed Mar. 13, 2013, the disclosure of which is hereby incorporated herein, in its entirety, by reference.

BACKGROUND OF THE INVENTION

1. Field of the Invention

The present invention is directed to a machine for making saw cuts and drilling holes into a paved slab.

2. Background of the Invention

With reference to the section of road 1 as shown in FIG. 1, a common practice for repairing damaged sections of concrete slabs 2 forming the lanes 3 of a road is to cut out and remove a damaged section and pour and finish a concrete patch in the remaining hole. The area around lateral control joints 5 formed in the slabs 2 which have degraded over time are areas that are commonly in need of repair. The concrete slab 2 forming a road is typically poured as a generally continuous slab. The slab may be approximately nine to twelve inches thick. Saw cuts are then cut into the slab 2, commonly about one third of the thickness of the pavement, to provide an area of weakness at which cracks will naturally form in the slab 2. Longitudinal joints 6 are formed longitudinally along the slab 2 to separate adjacent lanes 3 and the lanes from the shoulder 7. Lanes 3 that are typically twelve feet wide. Lateral control joints 5 are formed laterally across the slab 2 typically approximately fifteen feet apart.

Damage at the lateral control joints 5, typically starts with chipping and spawling of the edges of the joint 5, forming a small depression which then grows as tires continuously pound against the defect and water seeps into the cracks therein and freezes further expanding the defects. Over time cracks will also form extending outward from the joint 5. In addition, cracks may form across the slab between control joints 5 which is more common when the spacing between control joints 5 is increased, such as for example thirty foot spacings.

A typical procedure for repairing a slab having a degraded control joint 5 is to cut out and remove a specified amount of the concrete slab 2 on either side of the degraded joint 5. The width of the slab to be removed may vary depending on specifications established by the jurisdiction in charge of the road repair. Typically, the jurisdiction or owner will specify removing at least two to three feet of the concrete slab 2 on either side of the joint 5 and in some cases up to approximately five feet on either side of the joint 5.

In repairs, two parallel, lateral cuts 11 are made through the concrete slab outward from the crack on opposite sides the distance specified. Parallel, longitudinal cuts 12 are also made between the lane 3 in which the slab section to be removed is located and the adjacent lane 3 and between it and the shoulder 7. A typical lane width is twelve feet and therefore the parallel longitudinal cuts 12 are typically made approximately twelve feet apart. Holes 14 are then drilled in the fragmented section to be removed. Expansion pins are then inserted into the holes and expanded to lock the pins in the holes. The pins are connected together by a harness that is then lifted with an excavator or the like to lift the pins and the fragmented section connected thereto from the rest of the concrete roadway or slab 2 to leave a hole in the roadway to be filled with a patch.

After the fragmented section is removed, concrete is placed or poured in the remaining hole 15 and leveled and finished to present a relative smooth upper surface.

Road patching operations, particularly in and around cities, often must be completed between evening and morning rush hours while maintaining at least one lane in each direction open to traffic. The time required to make the saw cuts around and drill the holes in the section of the concrete slab to be removed is a significant limiting factor as to the number of fragmented slab sections that can be removed in the time allotted. Existing saws are generally a walk behind type or a riding type which require a single operator to make a single cut in the concrete. After the cuts are made another worker operates a pneumatic drill to drill the required holes in the slab, typically one or two holes at a time in an operation separate from the sawing.

There remains a need for a system for expediting the process of making the necessary cuts through and boring the required holes into a section of slab to be removed from a concrete slab such as a road bed slab.

SUMMARY OF THE INVENTION

The present invention is directed to a mobile sawing and drilling machine for making cuts through and boring holes into a section of a slab to be removed. The machine includes a pair of saw guide tracks with circular saws mounted thereon for linear movement therealong parallel spaced relationship that are mounted on a laterally expandable saw and track support frame. The saw and track support frame is rotatably suspended from a main frame and rotates about a vertical axis to permit the orientation of the saw guide tracks and the resulting parallel saw cuts across the slab to be adjusted. The saw and track support frame is laterally expandable to permit adjustment to the spacing between the saw guide tracks and therefore to adjust the spacing between saw cuts made by the saws mounted thereon. The saw guide tracks are each suspended from the laterally expandable saw and track support frame by one or more vertically extendable or telescoping legs operable to raise and lower the guide tracks and saws supported thereon relative to the paved slab in which cuts are to be made to advance a circular saw blade associated with each saw into or out of engagement with the paved slab. Each saw is mounted on a saw carriage and includes a hydraulic motor or the like for rotating the saw blade for making saw cuts in the paved slab. The saw and track support frame is rotatable three hundred and sixty degrees relative to the main frame about the vertical axis.

The sawing and drilling machine further includes at least one drill mounted on a drill support assembly that includes a laterally extendable or telescoping arm and a vertically extendable or telescoping leg to which the drill is attached at a lower end thereof. The drill support assembly is rotatably suspended from the saw and track support frame and rotatable relative thereto about the same vertical axis about which the saw and track support frame rotates. Lateral telescoping of the arm of the drill support assembly coupled with rotation of the arm allows infinite adjustability of the position of the drill over the paved slab for purposes of boring a hole therein. A drill bit extends from the drill below a lower end of the vertically telescoping leg which is operable to advance the drill bit into and out of engagement with the paved slab for boring a hole therein at a location selected by an operator.

The main frame may be mounted on a plurality of wheels, including one or more drive wheels, operable to independently move the main frame across the paved slab between locations at which cuts in the paved slab are to be made. In one embodiment, the main frame is constructed as a trailer to permit towing of the main frame to a section of a paved slab in which cuts and bores are to be made. The main frame includes a central section including front and rear telescoping support legs mounted on wheels and an upper frame interconnecting the legs and from which the saw and track support frame is rotatably suspended.

A rear frame is connected to and projects rearward from the rear telescoping legs of the center frame and a front frame is connected to and projects forward from front telescoping legs of the center frame. The front frame may be used to support a hydraulic fluid reservoir and power unit for supplying hydraulic fluid under pressure to the hydraulic actuators and motors used in operating the sawing and drilling machine. The front frame also includes a king pin or other coupling means to allow the trailer to be connected to a tractor or other prime mover. The rear frame may be used to support coolant tanks for holding water or the like used to cool the saw blades. The rear frame may also be used to support an air compressor for supplying compressed air for the drills and other equipment associated with the machine. Trailer support wheels are connected to the main frame for supporting the trailer during transport to a site at which time the telescoping rear and front legs of the center frame are retracted above the paved slab to facilitate transport. Once the trailer is advanced to a work site and uncoupled from the tractor, the rear and front legs of the center frame may be extended to support the weight of the trailer and lift the weight off of the trailer support wheels.

DETAILED DESCRIPTION OF THE PREFERRED EMBODIMENTS

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. The drawings constitute a part of this specification and include exemplary embodiments of the present invention and illustrate various objects and features thereof.

Figure 1:
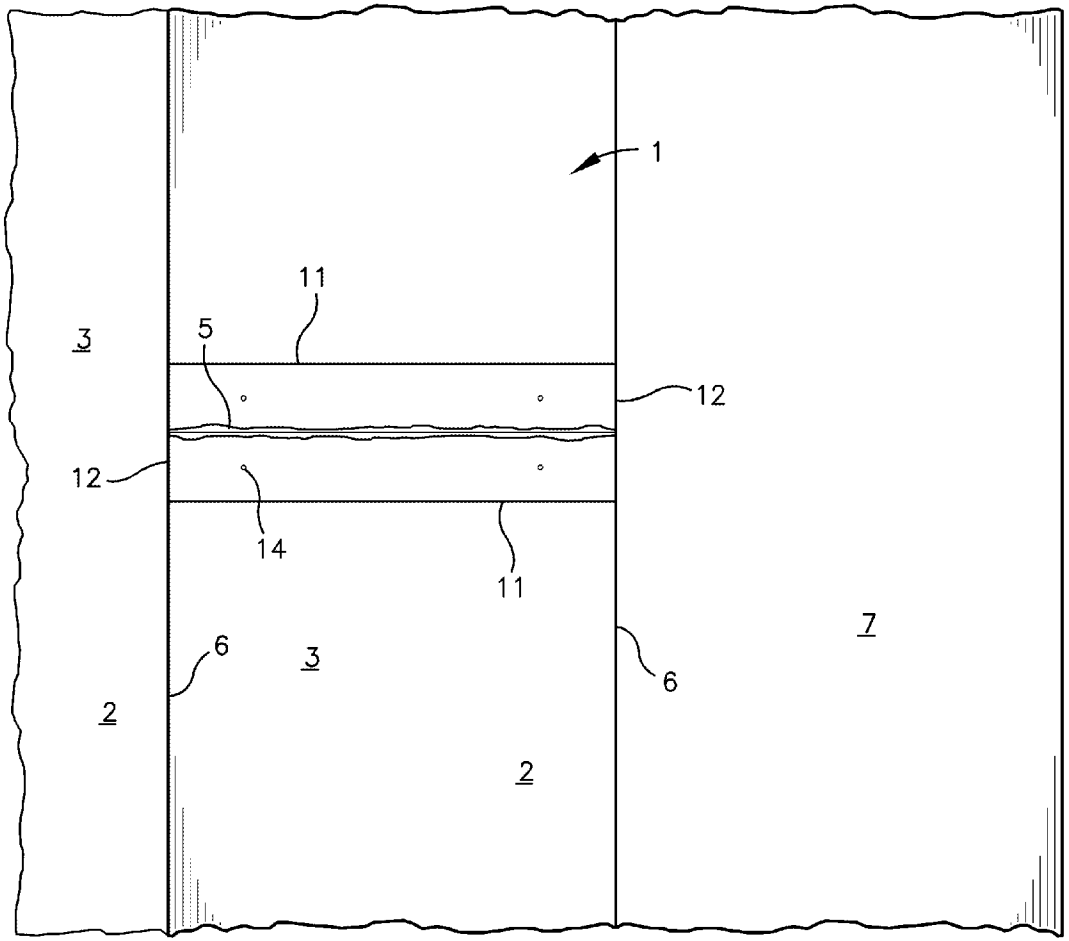
FIG. 1 is a diagrammatic top view of a section of roadway formed as a slab and divided into lanes and a shoulder and in which saw cuts and bore holes have been made.
Figure 2:
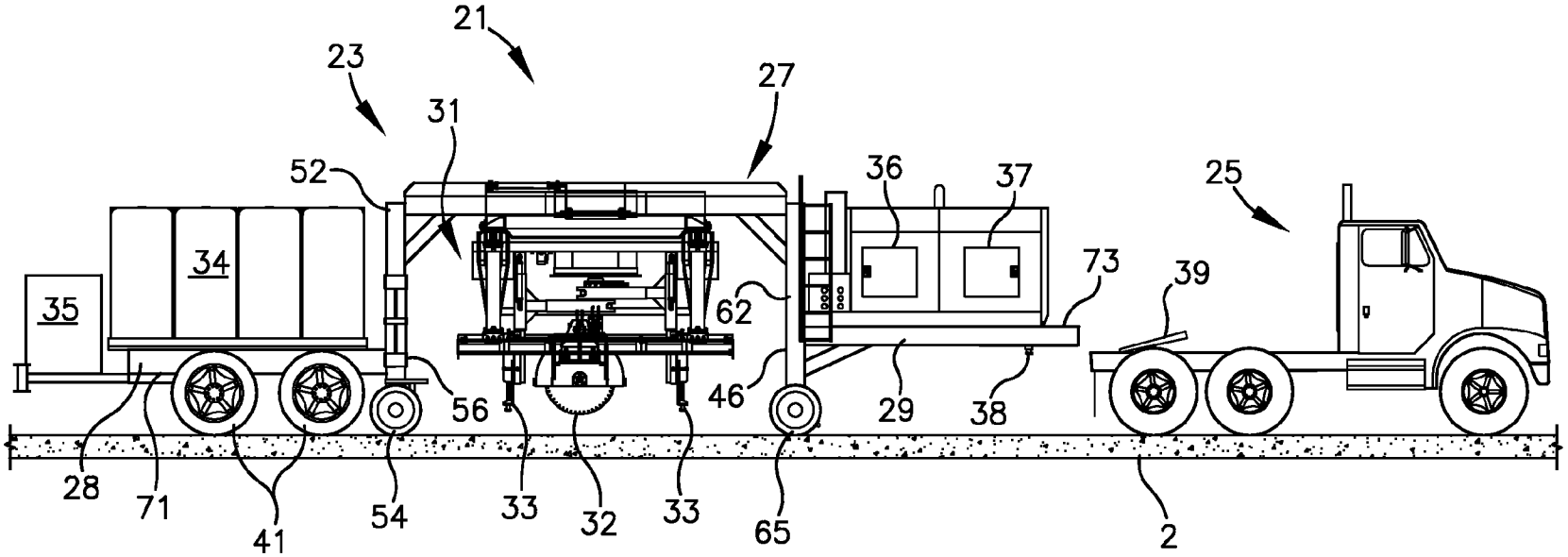
FIG. 2 is a side elevational view of a mobile sawing and drilling machine which may be coupled to a tractor for towing to a section of roadway in which saw cuts and drill holes are to be formed and which includes a saw and drill assembly suspended from a center section of a main frame and rotatable relative thereto.

With initial reference to FIG. 2, the reference number 21 generally designates a mobile saw and drilling machine or mobile saw and drill for making cuts through and boring holes into a section of a slab to be removed from a lane 3 of a road. When describing the mobile saw and drill 21 herein, directional references are generally made with reference to the direction of travel of the mobile saw and drill 21 along a lane 3 of the road in the intended direction of traffic thereon. In addition references to "horizontal" or "vertical" structure or features is intended to refer to the general orientation of the structure when the mobile saw is supported on a horizontal surface such as a slab 2 or lane 3 of a road. The mobile saw and drilling machine 21 includes a main frame 23 which, in the embodiment shown, is constructed as a trailer to be towed to a section of roadway for use by a tractor or tow vehicle 25.

The main frame 23 includes a central frame assembly 27, a rear frame assembly 28 and a front frame assembly 29. A saw and drill assembly 31 is suspended from the central frame assembly 27 so that the saw and drill assembly 31 rotates about a vertical axis relative to the central frame assembly 27. In the embodiment shown, the saw and drill assembly includes two saws 32 and two drills 33. Coolant tanks 34 and an air compressor 35 are mounted on and supported on the rear frame assembly 28 and a hydraulic fluid reservoir 36 and power unit 37 are mounted on and supported on the front frame assembly 37. A king pin 38 is shown connected to and projecting downward from the front frame assembly 29 for coupling to a fifth wheel hitch 39 on tractor 25. Two pairs of trailer support wheels 41 are mounted to the rear frame assembly 28 for supporting the main frame 23 as it is towed by the tractor 25.

Figure 3:
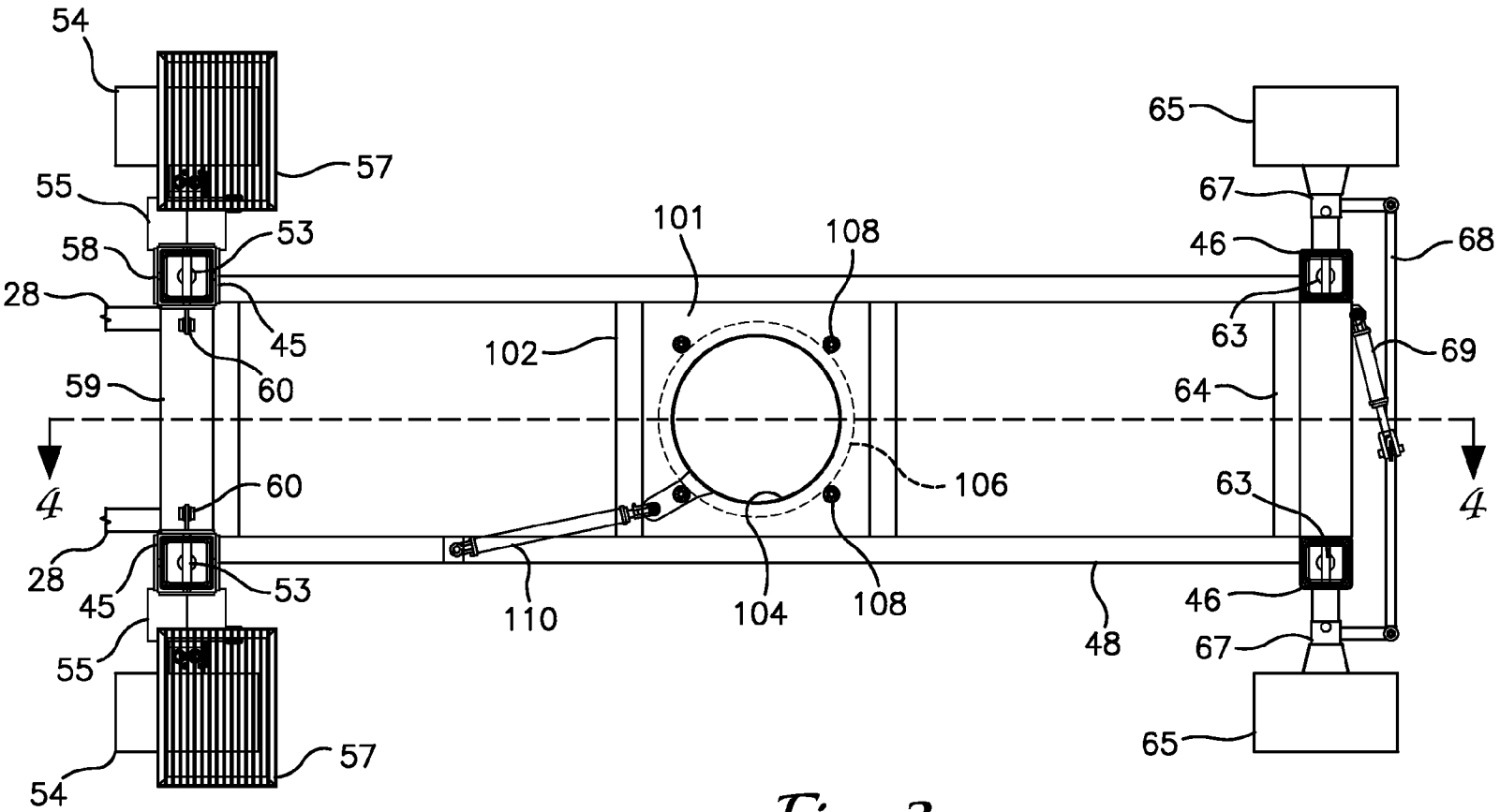
FIG. 3 is a top plan view of the center section of the main frame with the saw and drill assembly removed.
Figure 4:
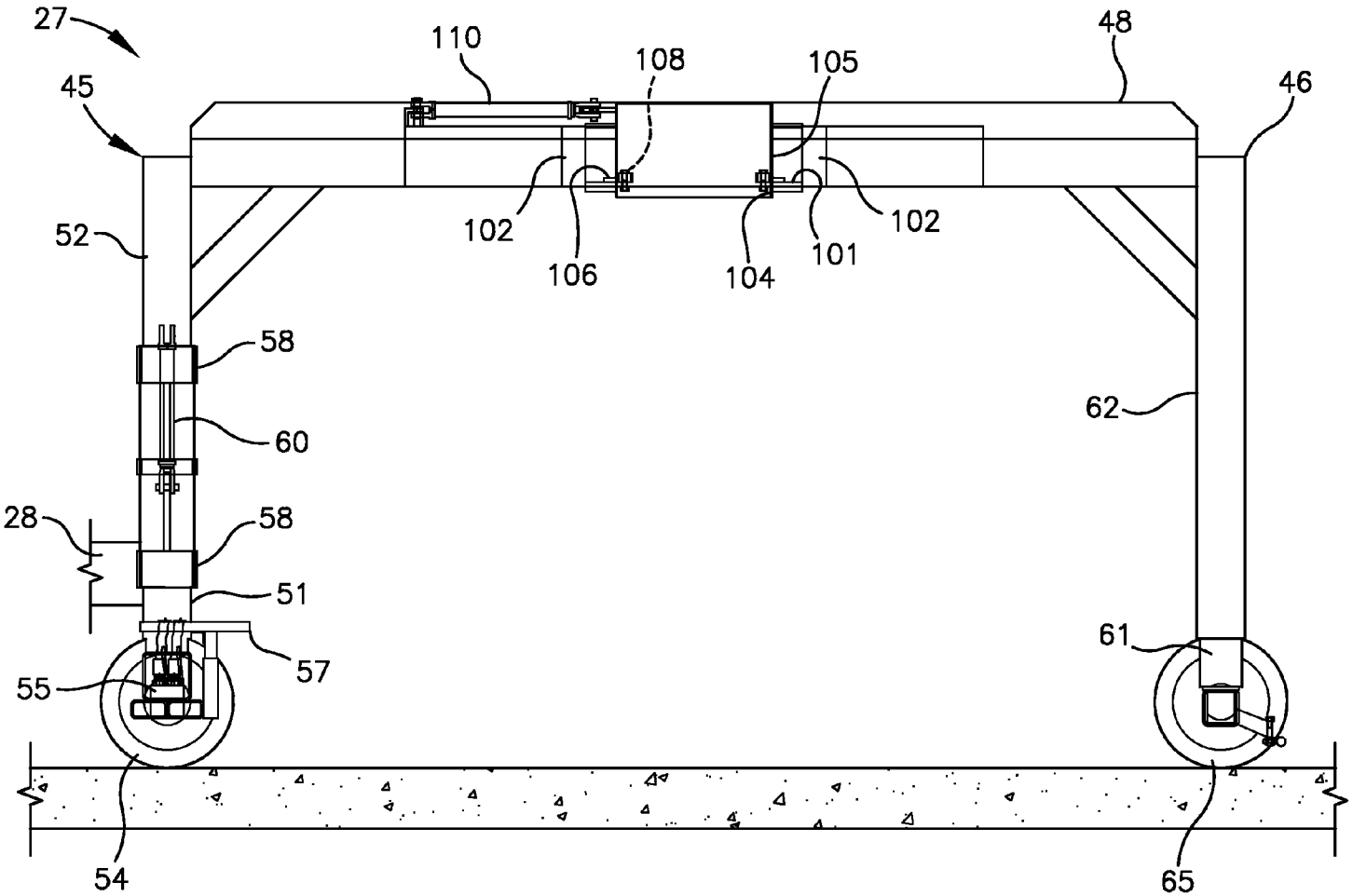
FIG. 4 is a cross-sectional view taken along line 4-4 of FIG. 3.
Figure 5:
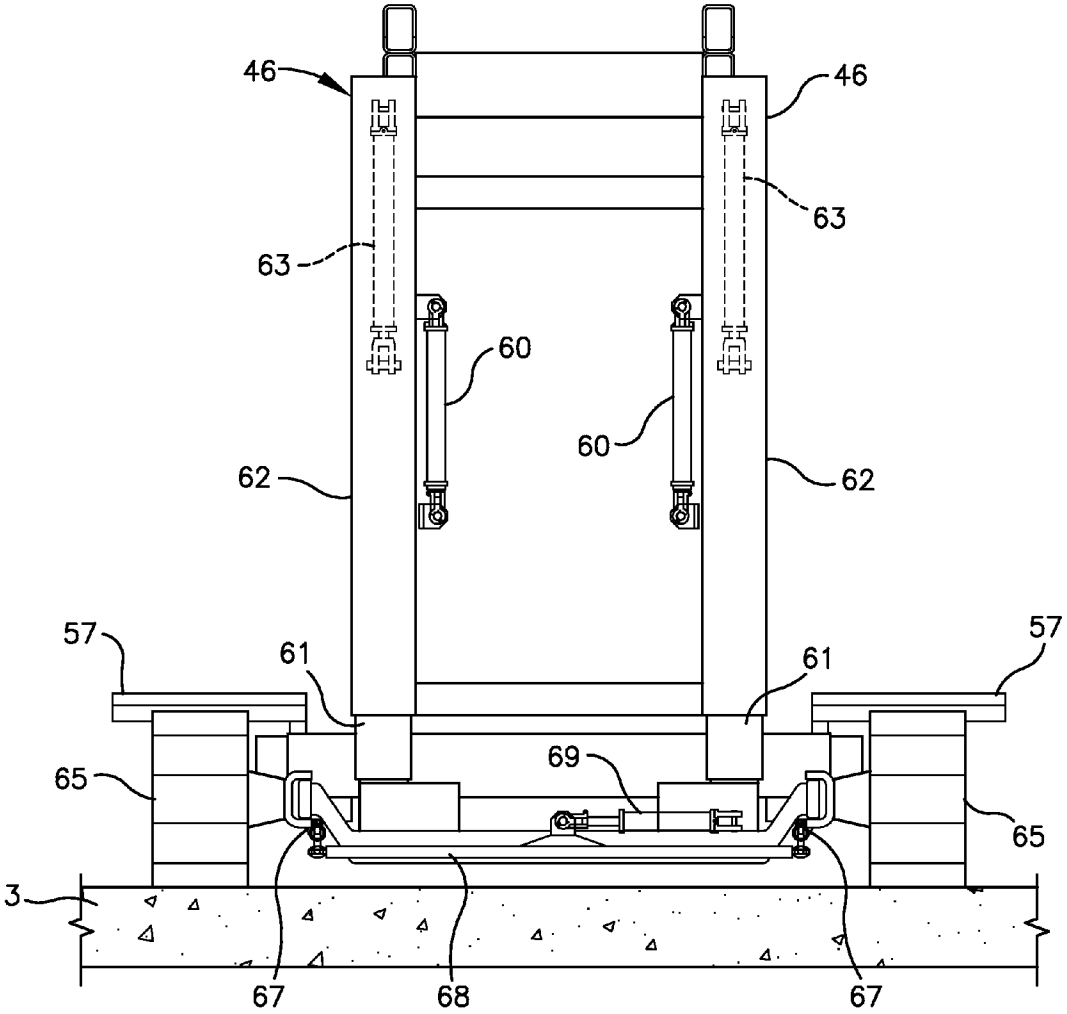
FIG. 5 is a front plan view of the center section of the main frame.

Referring to FIGS. 3-5, the central frame assembly 27 is shown without the saw and drill assembly 31 attached thereto. The central frame assembly 27 includes a pair of telescoping rear legs 45, a pair of telescoping front legs 46 and an upper saw and drill support frame 48 extending between and supported at upper ends of the telescoping front and rear legs 45 and 46. Saw and drill assembly 31 is suspended from saw and drill support frame 48 as discussed in more detail hereafter. Each telescoping rear leg 45 includes an inner tube or leg 51 slidingly received within an outer tube 52 and interconnected by a hydraulic actuator 53 mounted within the inner leg 51 and outer tube 52 and operable to selectively extend or retract inner leg 51 relative to outer tube 52. A rear cross-beam (not shown) is connected to and extends between the lower or distal ends of the telescoping inner legs 51 of rear legs 45. Drive wheels 54 are rotatably mounted on stub axles projecting outward from opposite ends of the cross-beam 54 and driven by a hydraulic motor 55 coupled thereto. Operator support platforms 57, on which an operator can stand, are connected to the cross beam and extend above each drive wheel 54.

A rear trailer lift assembly 56 is also incorporated into the rear legs 45. An exterior sleeve 58 formed by a plurality of angle irons and slats or straps in the embodiment shown is secured around the outer tube 52 of each rear leg 45. Front ends of the horizontal beams forming the rear frame assembly 28 are welded to a trailer support beam 59 which in turn is welded to and extends between the exterior sleeves 58 proximate a lower end thereof. An actuator 60 is connected between the outer tube 52 and the exterior sleeve 58 of each leg 45 to slide the exterior sleeve 58 and the attached rear frame assembly 28 vertically relative to the outer tube 52. By raising the exterior sleeve 58 and rear frame assembly 28 relative to outer leg 45 and the drive wheel 54 engaging the ground, weight can be taken off of the trailer wheels 41 and applied to the drive wheels 54 to provide more traction thereto.

Each telescoping front leg 46 similarly comprises an inner tube or leg 61 slidingly received within an outer tube 62 and interconnected by a hydraulic actuator (mounted within the tubes and not shown) operable to selectively extend or retract inner leg 61 relative to outer tube 62. A front cross-beam 64 is connected to and extends between the lower or distal ends of the telescoping inner legs 61 of front legs 46. A steerable wheel 65 is rotatably mounted on opposite ends of the front cross-beam 64 on steering arm assemblies 67 which allow rotation of the wheels 65 about a horizontal axis and pivoting of the wheels on the steering arm assemblies 67 about a vertical axis to permit steering of the mobile saw and drill 21. A steering linkage 68 interconnects the steering arm assemblies 67 and a linear actuator or steering actuator 69 is connected between the front cross-beam 64 and the steering linkage 68 to control steering of the front, steerable wheels 65.

The rear frame assembly 28 includes horizontally extending beams 71 welded to and projecting rearward from the outer tubes 52 of rear legs 45. Axles (not shown) for the trailer support wheels 41 are connected to and supported from the beams 71. Front frame assembly 29 includes horizontally extending beams 73 welded to and projecting forward from the outer tubes 62 of front legs 46. Once the mobile saw and drill 21 is towed to a section of roadway on which repairs are to be made, the main frame 23 is uncoupled from the tractor 25. Pairs of actuators 53 and 63 are extended to lower drive wheels 54 and front wheels 65 to engage the slab 2, lifting the frame 23 until the weight is supported on wheels 54 and 65 and not on the trailer support wheels 41. An operator may then move the mobile saw and drill 21 along a lane 3 of slab 2 by engaging the hydraulic motors 55 connected to drive wheels 54 and control steering through steering actuator 69.

The saw and drill assembly 31, which is shown separated from the central frame in FIGS. 6-11, includes a laterally telescoping saw and track support frame 77 which is rotatably suspended from the upper saw and drill support frame 48 by upper pivot assembly 79. Two saw drive track assemblies 81 and saw assemblies 82 are suspended from the saw and track support frame 77 on telescoping track support legs 85. Saw assemblies 82 are coupled to and operable to travel along the saw drive track assemblies or extendable rail assemblies 81 when cutting into a slab 2. The saw drive track assemblies extend in parallel, spaced relationship on opposite sides of the pivot assembly 79 and transverse to the direction of lateral expansion of the laterally telescoping saw and track support frame 77. The spacing between the saw drive track assemblies 81 is adjustable through lateral expansion and retraction of the laterally telescoping saw and track support frame 77. The orientation of the saw drive track assemblies 81 is then adjustable about a vertical axis and relative to a slab 2 by rotating the saw and track support frame 77 about the vertical axis extending through upper pivot assembly 79. And the height of the saw drive track assemblies 81 and saw assemblies 82 mounted thereon relative to the slab 2 is adjustable by extending or retracting the telescoping track support legs 85

A laterally telescoping drill support assembly 87 is rotatably suspended from the center of the saw and track support frame 77 by a lower pivot assembly 89. In the embodiment shown, two concrete drills 33 are suspended from the laterally telescoping drill support assembly 87 on vertically telescoping drill support legs 93 which are operable to raise and lower drill bits 95 of concrete drills 33 into and out of engagement with a slab 2. The vertically telescoping drill support legs 93 are suspended in planar alignment on the laterally telescoping drill support assembly 87 on opposite sides of the lower pivot assembly 89. The lower pivot assembly 89 is fixedly connected to and suspended from the center of the saw and track support frame 77. When the saw and track support frame 77 is rotated about a vertical axis by upper turntable assembly 79, the lower pivot assembly 89 rotates therewith such that the laterally telescoping drill support assembly 87 rotates about the same vertical axis with the laterally telescoping saw and track support frame 77. However, the laterally telescoping drill support assembly 87 may rotate about the vertical axis independent of rotation of the saw and track support frame 77.

Figure 6:
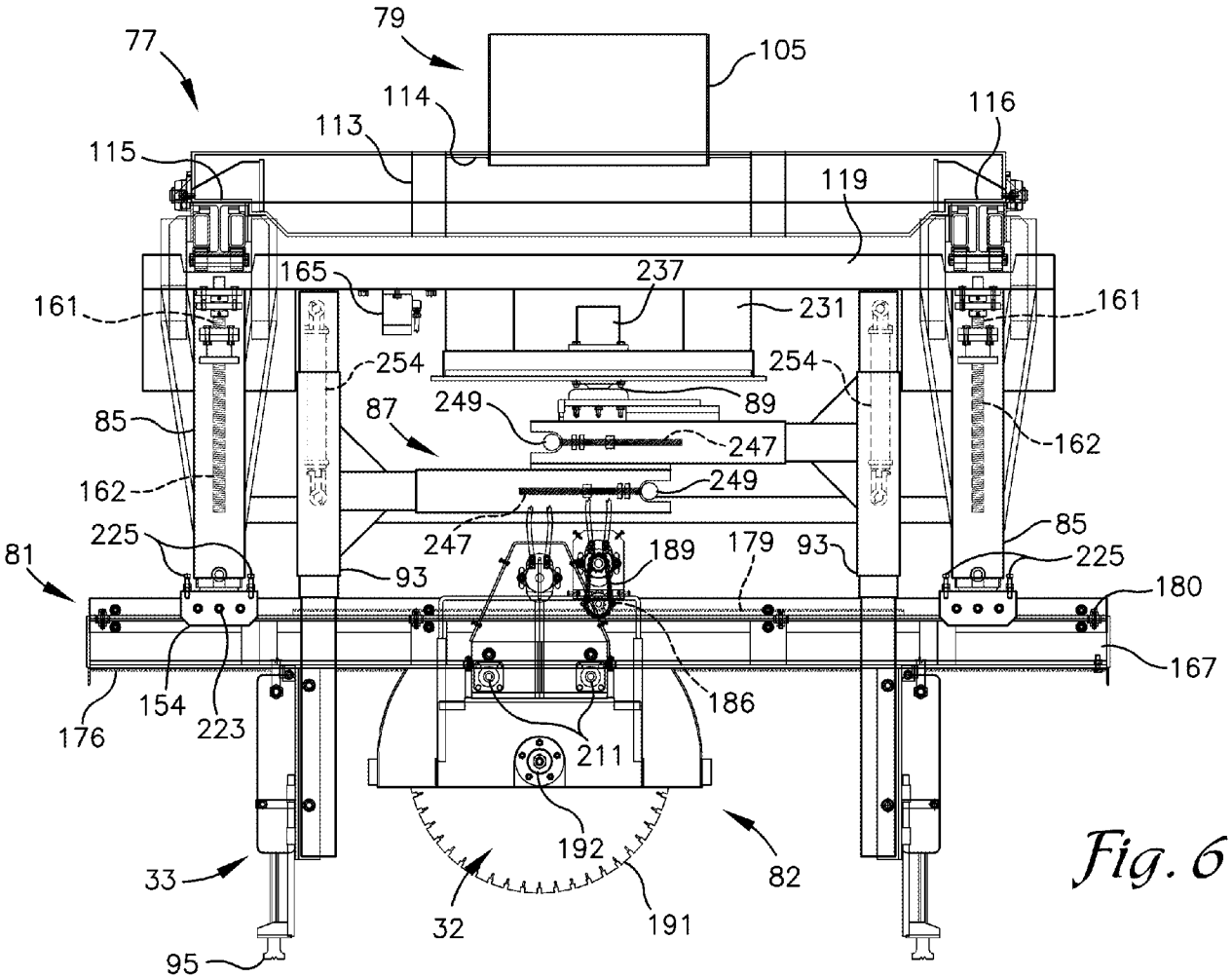
FIG. 6 is a side elevational view of the saw and drill assembly shown in spaced relationship over a paved slab and with a saw guide track and drill support assemblies shown retracted.
Figure 7:
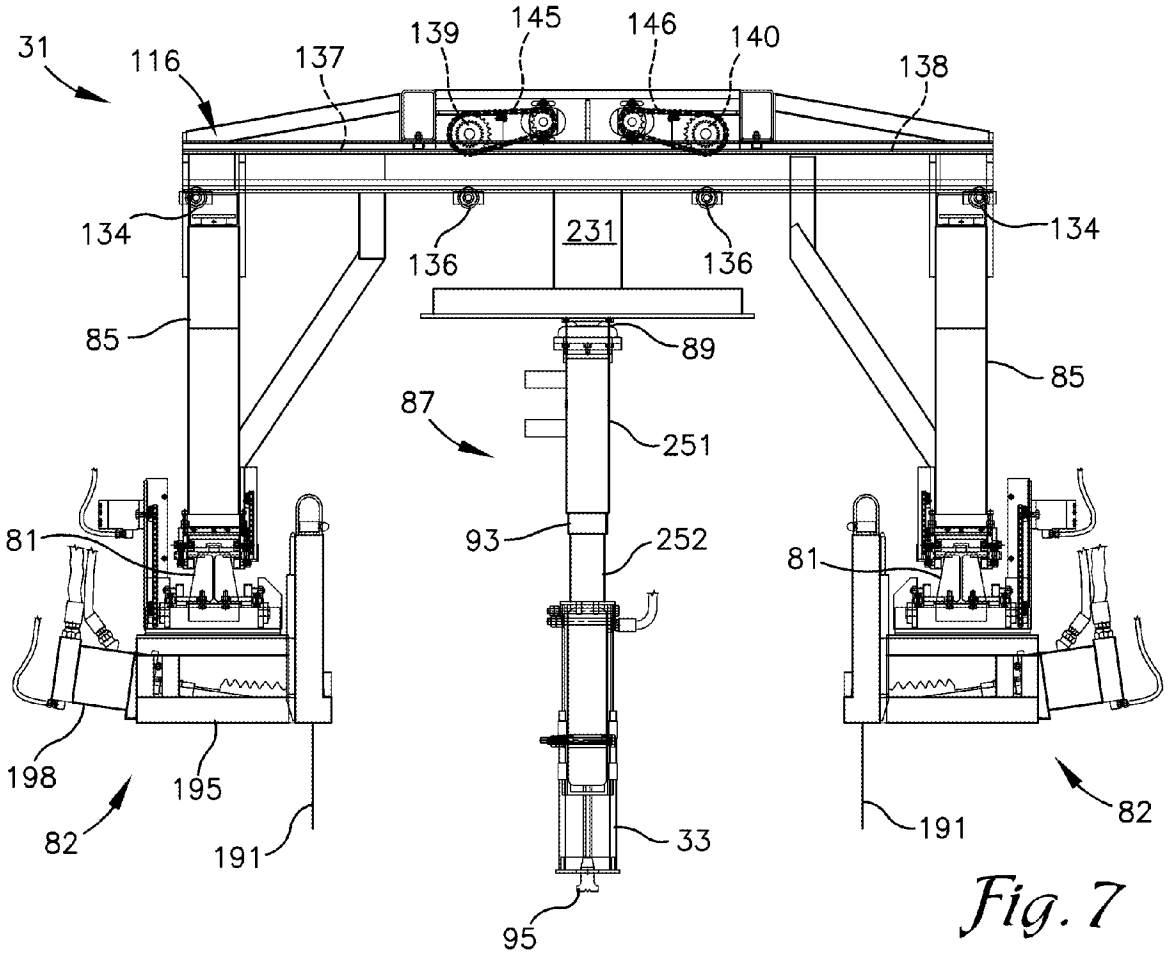
FIG. 7 is an end view of the saw and drill assembly showing a laterally telescoping saw and track support frame in a retracted configuration with a pair of saw guide tracks with saws supported thereon in a retracted position and a vertically telescoping drill support assembly shown extended.
Figure 8:
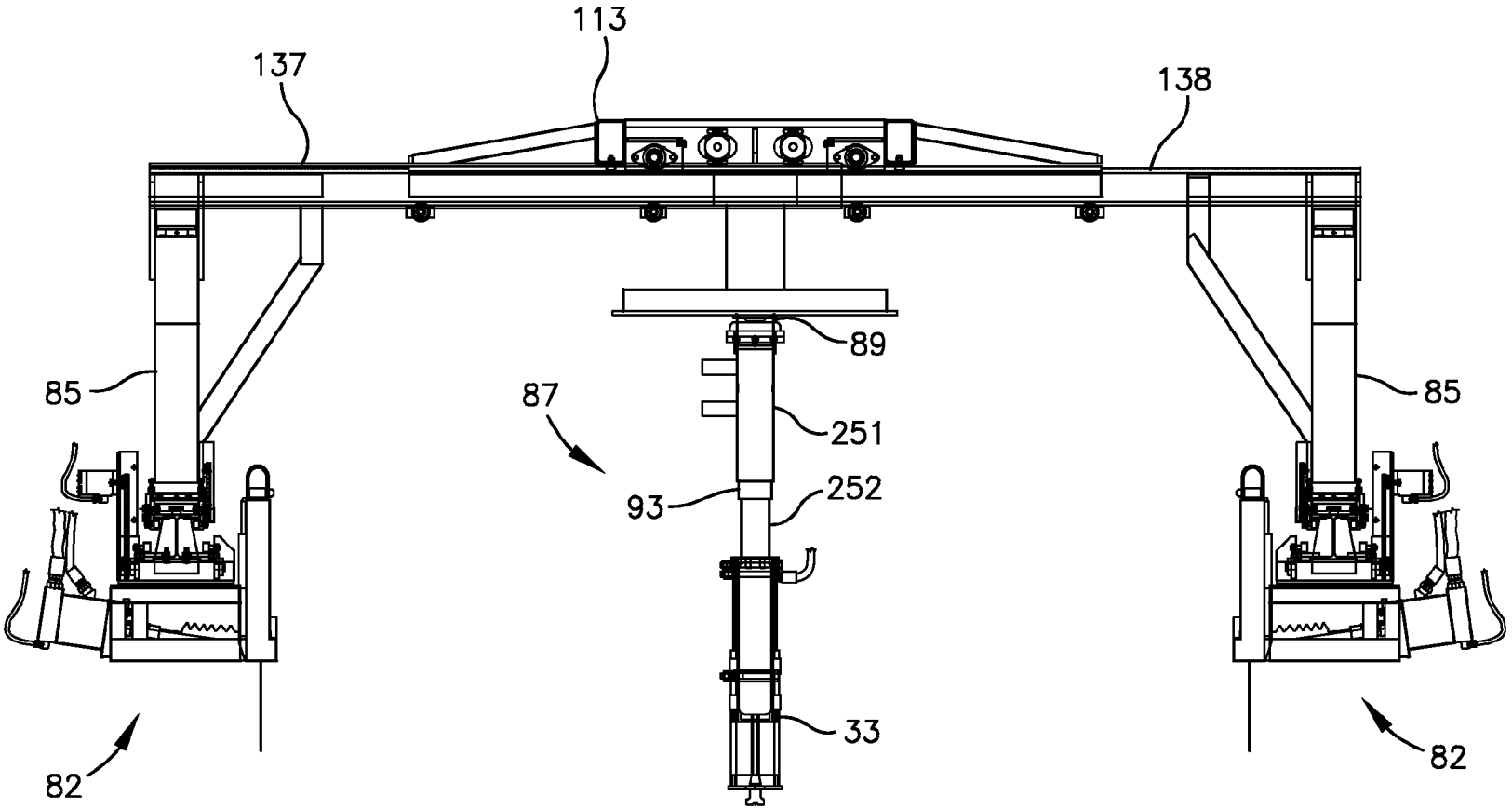
FIG. 8 is an end view similar to FIG. 7 showing the laterally telescoping saw and track support frame in an extended configuration.

The construction of the upper pivot assembly 79 is best seen with reference to FIGS. 3, 4 and 6. The saw and drill main support frame 48 includes a horizontally extending turntable support plate 101 welded across the bottom of a box sub-frame assembly 102 in the center of the saw and drill support frame 48. A circular opening or hole 104 is formed in and extends through turntable support plate 101. A vertical stub axle or shaft 105, having an annular flange 106 welded to and projecting radially outward therefrom, is connected to and projects upward from the center of the saw and track support frame 77. Circular flange 106 is wider in diameter than hole 104 in support plate 101. Shaft 105 extends through hole 104 and a peripheral portion of circular flange 106 extends over and is supported on turntable support plate 101 around hole 104. A plurality of roller bearings 108 are mounted on the support plate 101 around the hole 104 therethrough in spaced relation relative to an edge of the hole 104. The roller bearings 108 engage an outer edge of the circular flange 106 and function to center the shaft or stub axle 105 and the circular flange 106 relative to hole 104.

A linear actuator 110 is connected between the shaft 105 and the saw and drill support frame 48 for rotating or pivoting the shaft 105 and the attached saw and track support frame 77 relative to the saw and drill support frame 48. The actuator 110 is sized and positioned to permit rotation of the saw and track support frame 77 at least ninety degrees and preferably upwards of one hundred and ten or one hundred and fifteen degrees relative to the saw and drill support frame 48. The vertical axle 105 may be formed from a round tube having open ends and through which hydraulic and pneumatic hoses may be threaded for connection to hydraulic and pneumatic actuators, motors and the like used to control the operation of the mobile saw and drill 21.

A turntable stabilizing plate 111 with a shaft receiving hole 112 formed therein is welded to and extends across an upper end of the box sub-frame assembly 102 for stabilizing the turntable shaft 105 against rocking or lateral pivoting. The shaft receiving hole 112 is sized the same as turntable hole 104 which is just large enough for the shaft 105 to pass therethrough. The actuator 110 is connected to the turntable shaft 105 just above stabilizing plate 111.

The laterally telescoping saw and track support frame 77 includes a central box frame 113 connected at its center to the turntable shaft 105. The shaft 105 extends through and is welded to a support plate 114 welded to the box frame 113. Frame 77 further includes laterally telescoping beam assemblies 115 and 116 welded to the central box frame 113 and saw track support beams 119 and 120 connected to and extending across ends of aligned pairs of telescoping beams of the telescoping beam assemblies 115 and 116 as described in more detail hereafter.

Each laterally telescoping support beam assembly 115 and 116 comprises a stationary tube assembly 123 divided into inner and outer compartments 124 and 125 by an internal web or wall 127 extending between upper and lower flanges or walls 128 and 129. The embodiment of the stationary tube assembly 123 shown is constructed from an I beam (or an H beam oriented on its side to resemble an I-beam). An inner telescoping beam 131 is telescopingly mounted in the inner compartment 124 of each beam assembly 115 and an outer telescoping beam 132 is telescopingly mounted in the outer compartment 125 thereof. A reinforcing strap 133 is welded to the exterior surface of each beam 131 and 132 and extends along the length thereof.

A plurality of roller supports or bearings 134 are mounted on and project through openings in the lower flanges 129 to support and permit sliding movement of the inner and outer telescoping beams 131 and 132 within compartments 124 and 125. Inverted U-shaped channels with depending legs are welded to the underside of each beam 131 and 132 to form a guide track 135 to guide the beams 131 and 132 linearly as they are extended and retracted as discussed hereafter and restrain the beams 131 and 132.

In the embodiment shown, the inner and outer telescoping beams 131 and 132 are driven by rack and pinion assemblies including racks 137 and 138 welded to or otherwise formed on or mounted on an upper surface of each of the inner and outer telescoping beams 131 and 132 respectively and pinions or pinion gears 139 and 140 mounted on drive shafts 141 and 142. Pinion gears 139 mounted on opposite ends of shaft 141 engage racks 137 on inner telescoping beams 131 and pinion gears 140 mounted on opposite ends of shaft 142 engage racks 138 on outer telescoping beams 132. Each shaft 141 and 142 is driven by a separate hydraulic motor 143 and 144 drivingly coupled to the shaft 141 and 142 by a chain and sprocket assembly 145 and 146 respectively. Operation of motor 143 rotates shaft 142 and pinions 139 to slide inner telescoping beams 131 and the saw track support beam 119 connected across distal ends thereof inward or outward relative to the stationary tube assemblies 123 of beam assemblies 115 and 116 on a first side thereof. Operation of motor 144 rotates shaft 143 and pinions 140 to slide outer telescoping beams 132 and the saw track support beam 120 connected across distal ends thereof inward or outward relative to the stationary tube assemblies 123 of beam assemblies 115 and 116 on a second side thereof. It is understood that a single motor or drive means drivingly coupled to both shafts 143 and 144 by a single chain and sprocket assembly could be used to drive both shafts 143 and 144 and the associated pinions 139 and 140 simultaneously such that the saw track support beams 119 and 120 are always extended and retracted in unison relative to the stationary tube assemblies 123.

Each saw drive track assembly 81 is suspended from one of the saw track support beams 119 and 120 by two telescoping track support legs 85. Each telescoping track support leg 85 includes an outer tube 151 welded to and depending from the respective saw track support beam 119 and 120 and an inner leg or tube 152 sliding secured within outer tube 151. An inverted, U-shaped mounting bracket 154 is connected to the end of each inner tube 152 for connecting the inner tube 152 to a saw track base 156 of saw drive track assembly 81. The mounting bracket 154 includes a pair of depending flanges 158 depending from a central, horizontal web 159 in spaced apart relation. In the embodiment shown, a shank 160 projects upward from the bracket web 159 and inside of inner tube 152 to which it is pinned or bolted.

Inner tube 152 is coupled to outer tube 151 of each telescoping track support leg 85 by a jack screw assembly 161 including a jack screw 162 which when rotated extends and retracts the inner tube 152 relative to outer tube 151 to raise and lower the saw drive track assembly 81 connected thereto. Upper ends of the jacks screws 162 extend up through and into the respective saw track support beams 119 and 120. A chain and sprocket drive assembly 164, connecting the ends of the jack screws 162 in each saw track support beam 119 and 120 is connected to a jack screw drive motor 165 (one of which is shown in FIG. 6) for simultaneously rotating the two jack screws 162 associated with the respective saw track support beam 119 and 120. It is to be understood that each saw drive track assembly 81 may be raised or lowered independent of the other.

Each saw drive track assembly 81, shown from an end in FIGS. 15 and 16A-C includes a telescoping track beam 167 slidably mounted to and suspended below a respective saw track base member 156. The telescoping track beam 167, as best seen in FIG. 16B, is formed from an I-beam or H-beam oriented on its side to include an upper flange 169 and a lower flange 171 with an intersecting web 173 extending therebetween. In the embodiment shown a rectangular strap 175 is welded on top of and projects outward from or is cantilevered over each side of the lower flange 171 to extend the width of the lower flange 171. Straps 175 may be considered part of the lower flange 171. A rack gear 176 is mounted to or formed on an underside of each strap 175 for use in providing for longitudinal movement of one of the saws 32 along the track beam 167 as described in more detail hereafter.

Figure 16A:
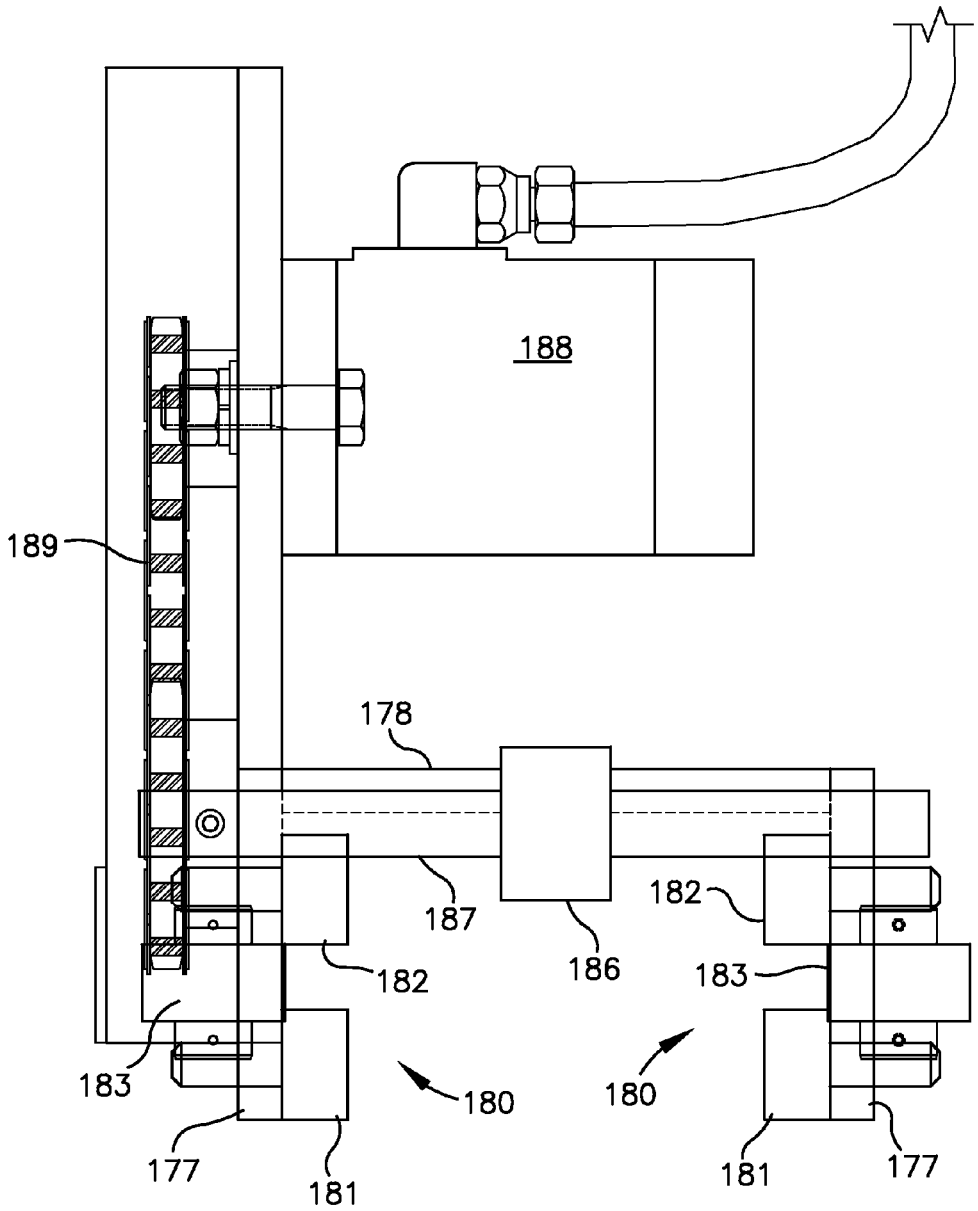
FIG. 16A is an enlarged and fragmentary, cross-sectional view of the saw guide track including the saw track base member taken generally along line 16A-16A of FIG. 12 with portions removed to show detail.

As best seen in FIG. 16A. Each saw track base member 156 includes a pair of depending sidewalls 177 projecting downward from a horizontal web 178 extending therebetween having a cross-section of an inverted U. A plurality of roller bearing assemblies 180 are mounted on inner surfaces of each sidewall 177 in horizontal alignment. Each roller bearing assembly 180 includes a lower roller bearing 181, an upper roller bearing 182 and a side roller bearing 183. An outer portion of each upper flange 169 is supported on the lower roller bearings 181 of the roller bearing assemblies 180 to permit the telescoping track beam 167 to slide horizontally relative to the saw track base member 156. The upper roller bearings 182 hold the flange 169 downward against the lower roller bearings 181 and the side roller bearings 183 maintain the telescoping track beam 167 centered laterally relative to the saw track base member 156.

An upper rack or rack gear 179 is secured to or formed on an upper surface of the upper flange 169 of each telescoping track beam 167 generally along the center thereof. A pinion 186 is mounted on an axle 187 extending through and supported on the sidewalls 177 of each track base member 156 and meshes with the rack gear 179. Axle 187 is driven by a hydraulic motor 188 mounted on top of the track base member 156 and operably coupled to axle 187 with a chain and sprocket assembly 189. Rotation of pinion 186 along rack gear 179 drives or moves the track beam 167 to which it is secured longitudinally relative to the track base member 156 out either side thereof. The web 178 of the track base member 156 is discontinuous adjacent the motor 188 forming a gap therein up through which the shaft 187 and pinion 186 extend.

Figure 15:
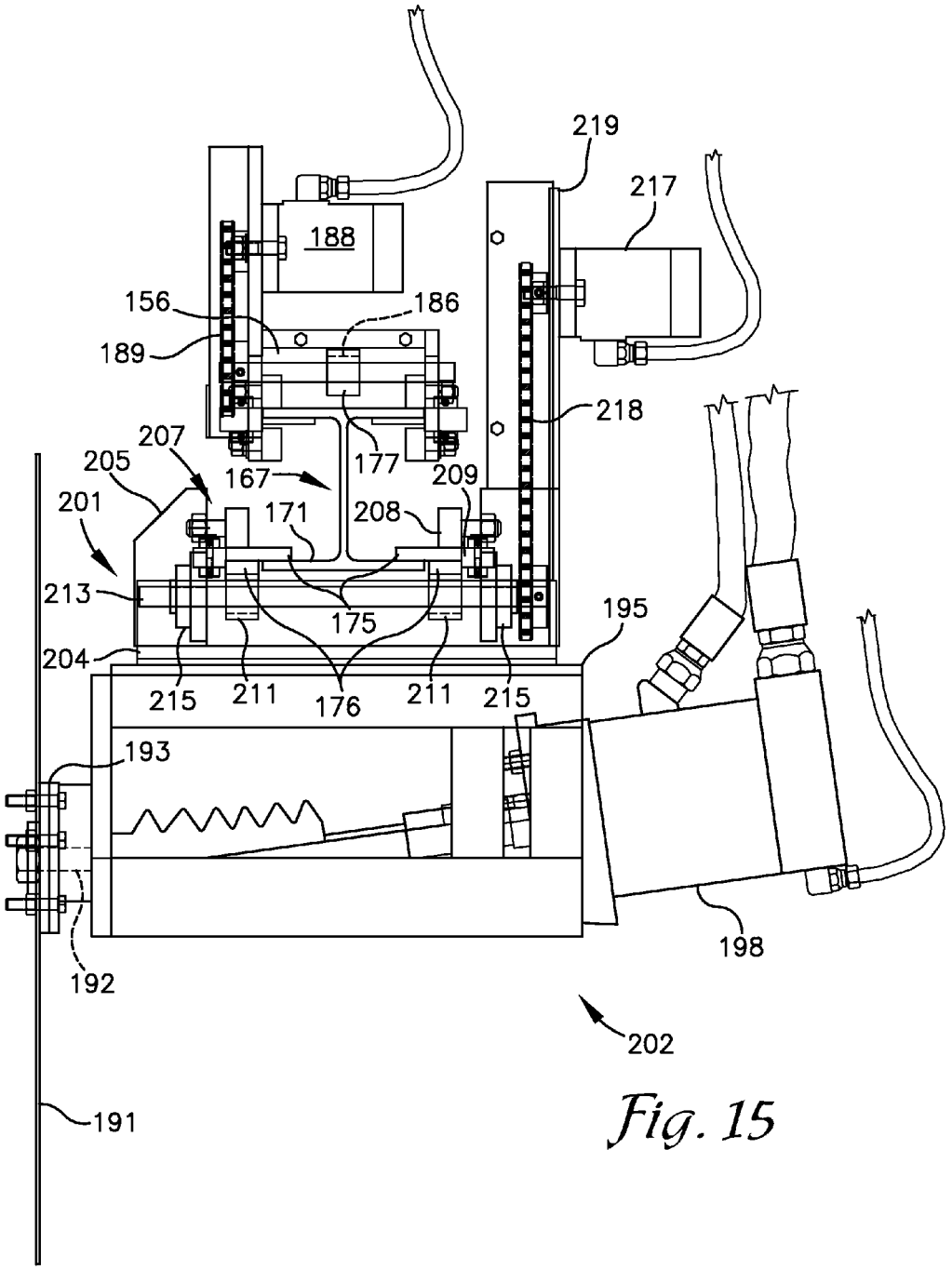
FIG. 15 is a greatly enlarged elevational view of an end of one of the saw guide tracks and the saw mounted thereon with portions removed to show detail.
Figure 16B:
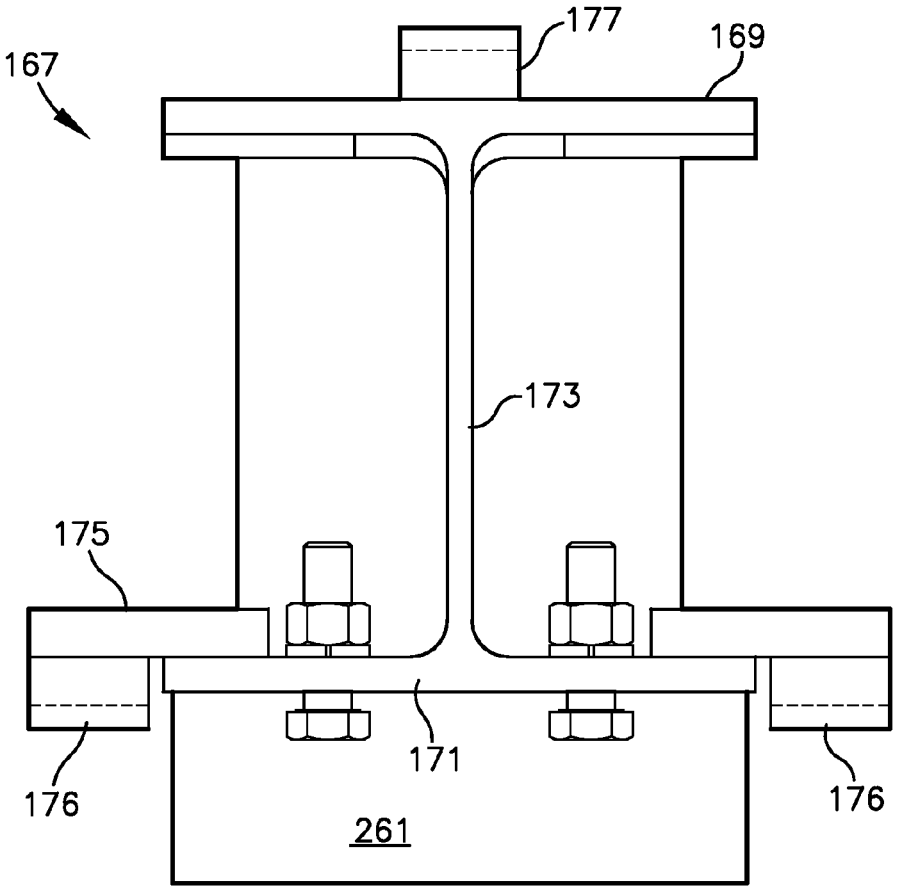
FIG. 16B is an enlarged elevational end view of one of the telescoping track beams forming part of the saw guide track with portions removed to show detail.
Figure 16C:
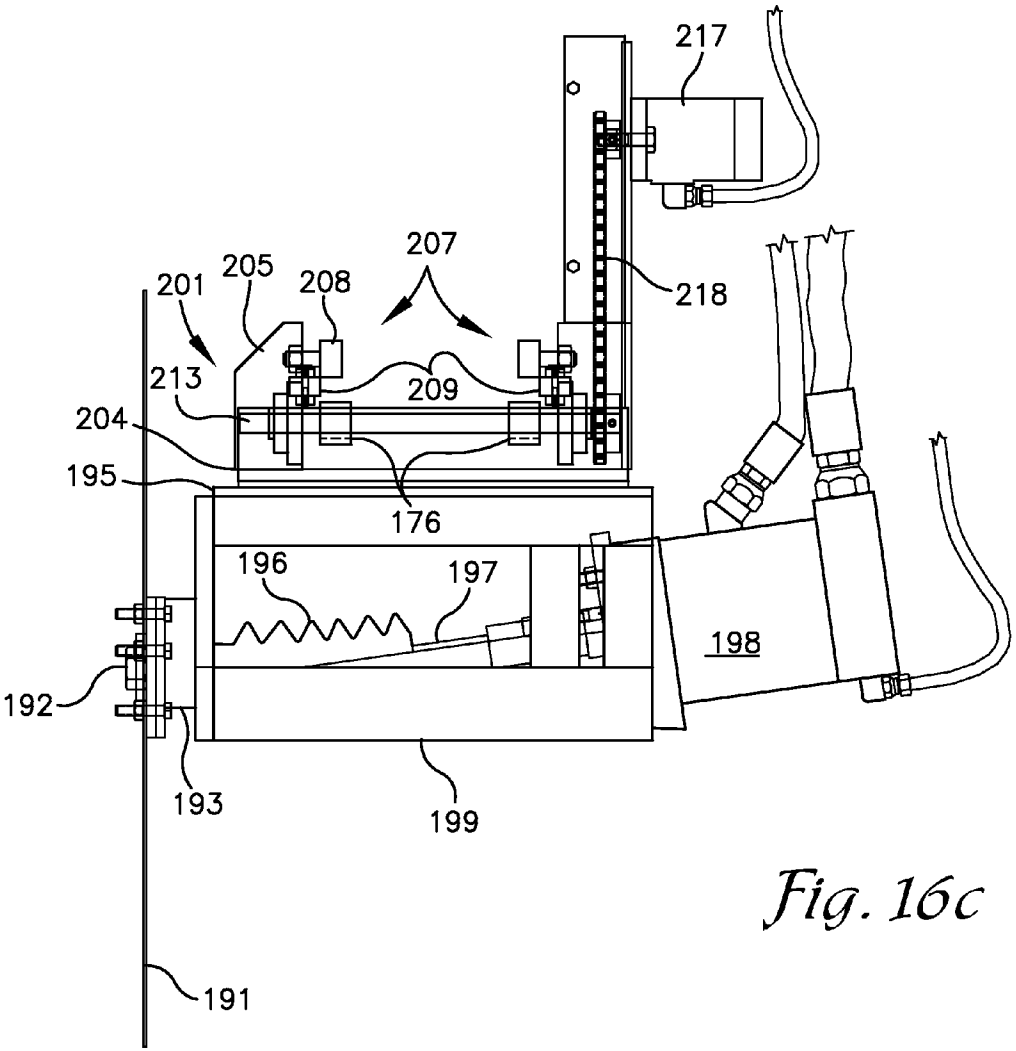
FIG. 16C is an enlarged elevational end view a saw and a saw carriage which connects the saw to the telescoping track beam.

As best seen in FIGS. 15 and 16C, each saw 32 includes a circular saw blade 191 rotatably mounted on a saw blade shaft 192 supported by bearing assembly 193 connected to a housing 195. The housing 195 encloses a transmission 196 connecting the saw blade shaft 192 to the output shaft 197 of a hydraulic motor 198. The hydraulic motor 198 is generally mounted on a side of the housing 195 opposite the saw blade 191. The motor 198 is mounted on the side of the housing 195 at an angle extending upward and away from a bottom 199 of the housing 195 so that no portion of the motor 198 or the hydraulic fittings connecting hydraulic supply lines thereto extends below the housing 195 which may extend in contact with an upper surface of the slab 2 in which the saw blades 191 are used to make saw cuts.

A carriage 201 is mounted to a top of the housing 195. The housing 195 and carriage 201, as shown in FIG. 16C may be referred to as a saw carrier 202. The carriage 201 for each saw 32 is supported on the lower flange 171 of a respective track beam 167 and operably provides longitudinal movement of the saw 32 relative to the track beam 167. The carriage 201 for each saw 32 includes a base plate 204 welded or bolted to the top of the housing 195 and a pair of upstanding brackets 205 projecting upward from the base plate 204 on opposite sides of the track beam 167. Two pairs of roller bearing assemblies 207 are mounted on each bracket 205 and include an upper roller bearing 208 and a side roller bearing 209. The upper roller bearings 208 are supported on an upper surface of the lower flange 171 of track beam 167 and the side roller bearings 209 engage a side edge of the lower flange 171. A pair of pinions or pinion gears 211 mounted on shaft 213 extend below and mesh with respective rack gears 176 mounted on the bottom of lower flange 171. Ends of the shaft 213 extend through and are supported on bearings 215 mounted on brackets 205. An end of the shaft 213 opposite the saw blade 191 is coupled to a hydraulic motor 217 by a chain and sprocket assembly 218. Hydraulic motor 217 is mounted on a motor mount 219 connected to and projecting upward from the carriage base plate 204 along an outer edge thereof opposite the saw blade 191 and in spaced relation from the telescoping beam assembly 115 or 116 to which it is mounted. Rotation of the pinion gears 211 relative to rack gears 176 by motor 217 advances the saw carrier 202 along the track beam 167 in either longitudinal direction.

Figure 17:
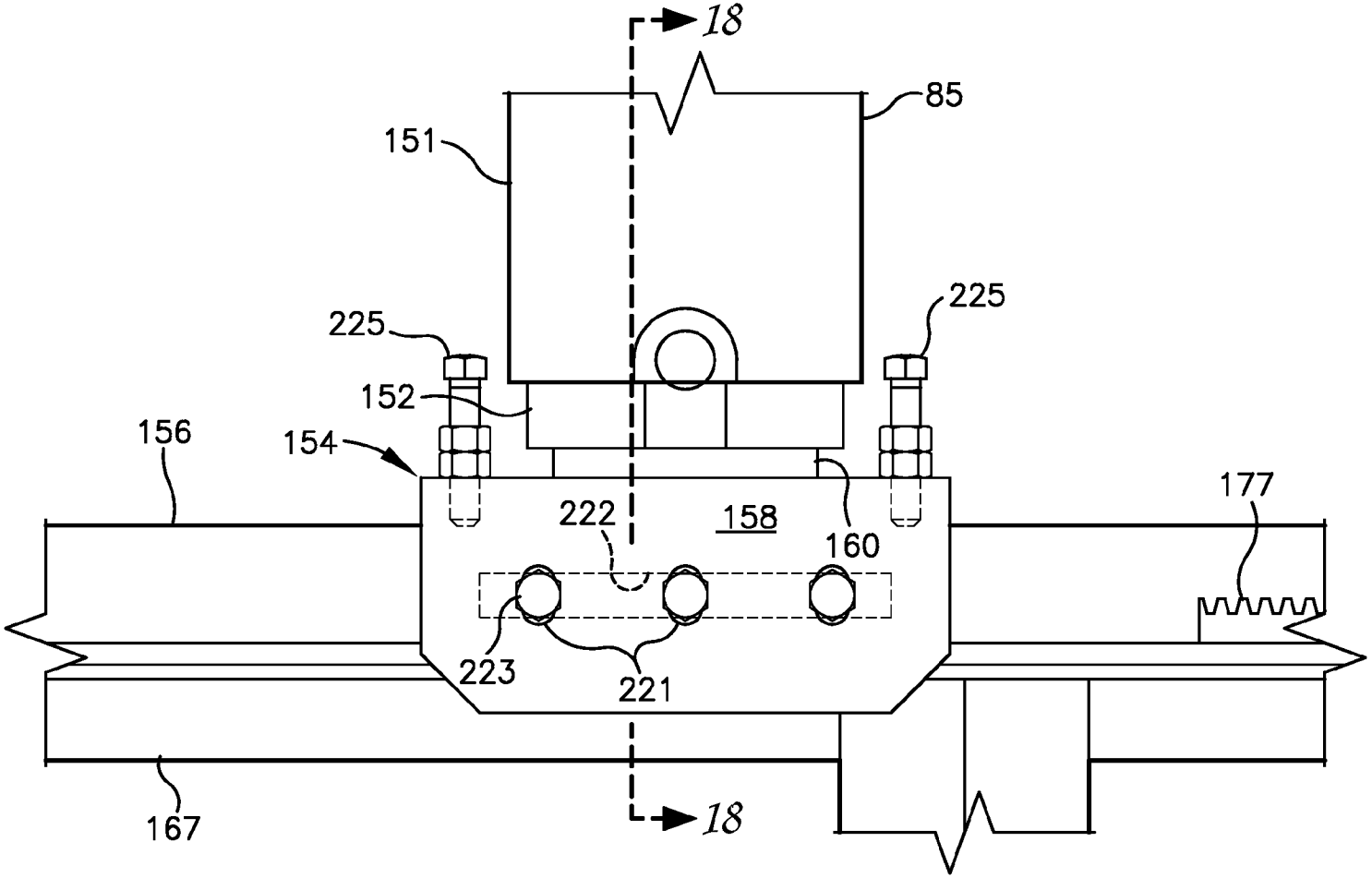
FIG. 17 is an enlarged and fragmentary side view showing a bracket connecting the track support leg to a base member of the saw guide track.
Figure 18:
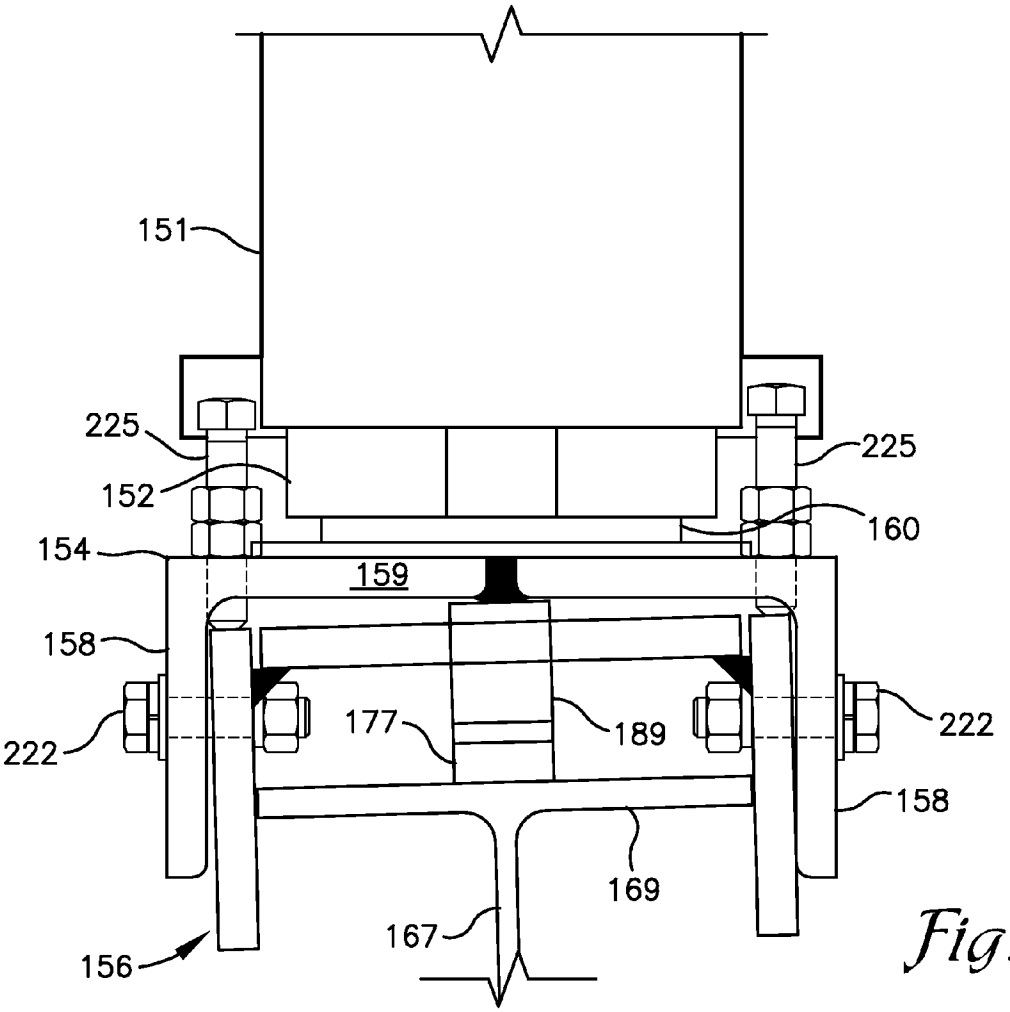
FIG. 18 is a fragmentary, cross-sectional view taken generally along line 18-18 of FIG. 17 showing the base member of the saw guide track angled at a slight angle from vertical relative to the bracket to angle the saw blade supported thereon correspondingly.

The saw blade shaft 192 projects perpendicular to and from the housing 195 and the housing 195 is mounted square to the track beam 167 such that when the respective telescoping beam assembly 115 or 116 is mounted square relative to the mounting brackets 154 the saw blade 191 cuts generally perpendicular to the slab 2 across which it is advanced while rotating. With reference to FIGS. 17 and 18, the angle of the saw blade 191 relative to the slab, may be adjusted by adjusting the angular orientation of the associated saw track base member 156 relative to the respective mounting bracket 154. Each depending flange 158 of brackets 154 includes a plurality of elongate bolt holes 221 extending therethrough. A slot 222 is formed in each sidewall 177 of the saw track base member 156. Brackets 154 are bolted to the sidewalls 177 of track base member 156 using bolts 223 extending through aligned bolt holes in opposed depending flanges 158 and through the slots in sidewalls 177 of the saw track base member. The bolt holes 221 may be formed as slightly elongated vertical slots which permits the saw track base member 156 to be angled slightly about a longitudinal axis relative to the inverted U-shaped brackets.

Set screws 225 extending through the horizontal web 159 of each bracket 154 may adjusted to engage the upper surface of the saw track base member 156 to fix the angled orientation of the saw track base member 156 relative to brackets 154. When the saw track base members 156 are angled relative to the brackets 154 to which they are secured, the saw blade 191 will be angled at a corresponding angle to the slab 2 across which it is used to make a saw cut which in this case will be angled relative to vertical. In FIG. 18, the saw track base member 156 is shown angled or tilted approximately two degrees to the left relative to vertical such that the saw blade 191 attached thereto or the axis of rotation of the saw blade 191 would be angled two degrees off of vertical. By adjusting the angle of the saw track base member 156 relative to the bracket 154, the angle between the saw drive track assembly 81 and the saw blade 191 are being adjusted relative to the vertical support legs 85 from which they are suspended. In the embodiment shown, the saw track base member 156 with slots 222 formed in sidewalls 177, in combination with bracket 154 with elongate bolt holes 221 and bolts 223 and set screws 225 function as means for angling the orientation of the axis of rotation of each saw blade 191. It is foreseen that other means for adjusting the angle of the saw blade 191 or saw blade axis of rotation relative to the vertical support legs 85 and therefore relative to the slab to be cut could be utilized. The saw blades 191 on opposite sides may be angled at opposite equal angles so as to angle inward toward the bottom of each blade 191 to form downwardly and inwardly sloping cuts in the slab which will make it easier to remove the section cut therefrom.

It is to be understood that the saw carriers 202 and attached saws 32 may be pulled or run off the end of the track beam 167 on which it is mounted and rotated one hundred and eighty degrees and reattached to the track beam 167 so that the saw blade 191 can be positioned on either side of the track beam 167 and the saw drive track assembly 81. By positioning the saw blades 191 on the inside of each track beam 167 narrower spacing between the saw cuts can be obtained and by positioning the saw blades 191 on the outside of each track beam 167 wider spacing between the cuts can be obtained. It is to be understood that the saw blades 191 travel parallel to the track beams 167 when in use.

Referring to FIGS. 6 and 12-14, the lower pivot assembly 89 supporting the laterally telescoping drill support assembly 87 is mounted on a sub-frame 231 suspended below the central box frame 113 of saw and track support frame 77. The lower pivot assembly 89 includes an upper bearing 233 mounted on sub-frame 231 and a lower bearing 234 connected to the lateral telescoping drill support assembly 87 and a shaft (not shown) extending between and supported on bearings 233 and 234. The shaft of lower pivot assembly 89 is driven by a hydraulic motor 237 mounted on sub-frame 231 of saw and track support frame 77 and engages the shaft to operably rotate the laterally telescoping drill support assembly 87 through a complete circle or 360 degrees.

The laterally telescoping drill support assembly 87 includes an upper laterally telescoping arm 241 connected to and suspended from the lower bearing 234 and a lower laterally telescoping arm 242 connected to and suspended from the upper laterally telescoping arm 241. Each telescoping arm 241 and 242 includes an outer tube 245 and an inner tube 246 slidably secured within the outer tube 245. Inner tube 246 of lower laterally telescoping arm 242 extends out of outer tube 245 in a direction opposite from which or 180 degrees relative to the direction which inner tube 246 of upper laterally telescoping arm 241 extends out of the outer tube 245 within which it is secured. A jack screw assembly (not shown) connecting the inner tube 246 to the outer tube 245 is operable to extend and retract the inner tube 246 relative to outer tube 247. Each jack screw assembly is driven by a reversible electric motor 249 connected to the outer tube 245 of the respective upper and lower telescoping arm 241 and 242. The connection between the upper and lower laterally telescoping arms 241 and 242 is along the outer tubes 245 thereof.

One of the vertically telescoping drill support legs 93 is connected to and supported on the end of the inner tube 246 of each laterally telescoping arm 241 and 242. Each drill support leg 93 includes an outer tube 251 and an inner tube or leg 252 slidably secured in the outer tube 251. The outer tube 251 is welded to and extends perpendicular to or vertically relative to a distal end of the inner tube 246 of one of the laterally telescoping arms 241 or 242. Each inner leg 252 is connected to an outer tube 251 by a linear actuator 254 such as a hydraulic actuator which is operable to extend and retract the inner leg 252 relative to the outer tube 251.

A rock drill 33 is secured to the extendable and retractable inner leg 252 of each vertically telescoping drill support leg 93 with a drill bit 92 of each drill 33 extending below the associated inner leg 252 such that the drill bits 95 are vertically oriented. The rock drill 33 shown is driven pneumatically but it is understood that the drills could be driven hydraulically, electrically or mechanically. Extension and retraction of the vertically telescoping drill support legs 93 advances the drill bits 95 into and out of engagement with the concrete slab 2 for boring holes therein. Rotation of the laterally telescoping drill support assembly 87 and horizontal extension of the arms 241 and 242 allows infinite adjustability in the positioning of the drills 33 for boring holes in the slab 2. Both of the drills 33 may be operated simultaneously and compressed air to power the drills 33 is supplied through air hoses 259 connected between the drills 33 and the air compressor 35. With two drills 33 mounted one hundred and eighty degrees apart as shown, it is foreseen that the rotatability of the drill support assembly 87 could be limited to one hundred and eighty degrees and still allow the two opposingly oriented drills 33 to reach any point in a three hundred and sixty degree circle within the reach of the laterally telescoping arms 241 and 242. Although two drills 33 mounted on laterally telescoping arms and vertically telescoping legs, or drill support assembly, are shown, it is foreseen that a single drill 33 mounted on a drill support assembly including a single laterally telescoping arm 241 and a single vertically telescoping leg 85 could be utilized. If only one drill 33 is used, complete or three hundred and sixty degree rotatability of the drill support assembly 87 is preferred.

Figure 9:
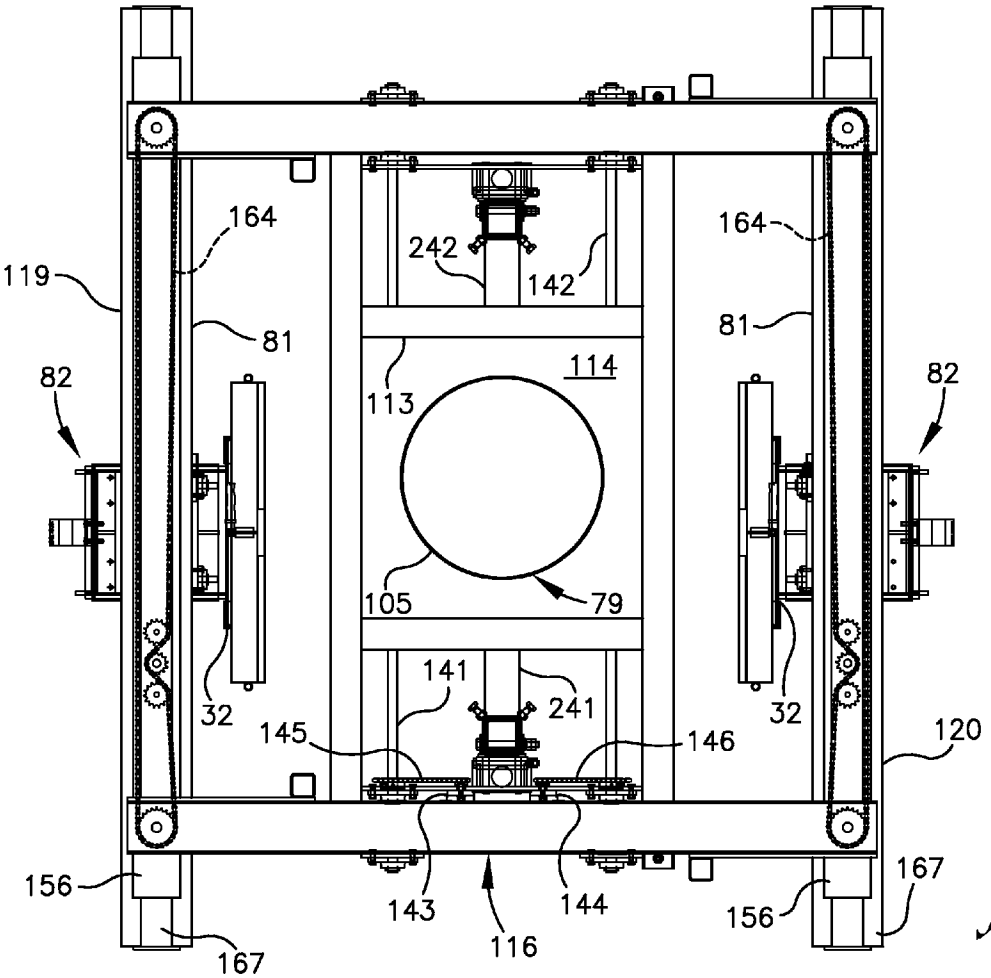
FIG. 9 is a top plan view of the saw and drill assembly showing the laterally telescoping saw and track support frame in a retracted configuration showing the drill support assemblies shown oriented for transport in parallel alignment with the saw guide tracks.
Figure 10:
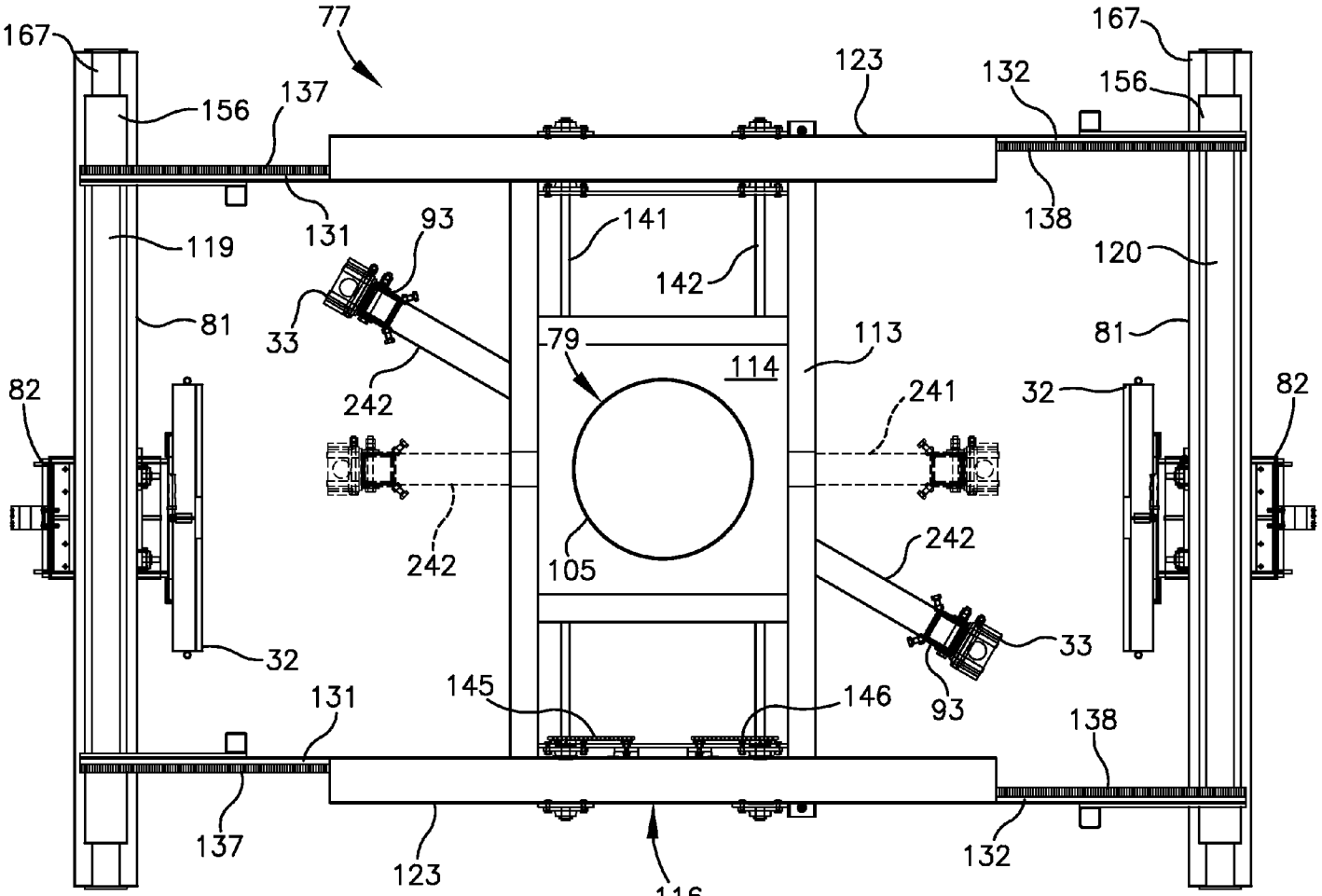
FIG. 10 is a top plan view of the saw and drill assembly showing the laterally telescoping saw and track support frame with the saw guide tracks mounted thereon in an extended configuration and the drill support assemblies rotated forty five degrees from the orientation of FIG. 9 and showing in phantom lines the drill support assemblies rotated ninety degrees from the orientation of FIG. 9.
Figure 11:
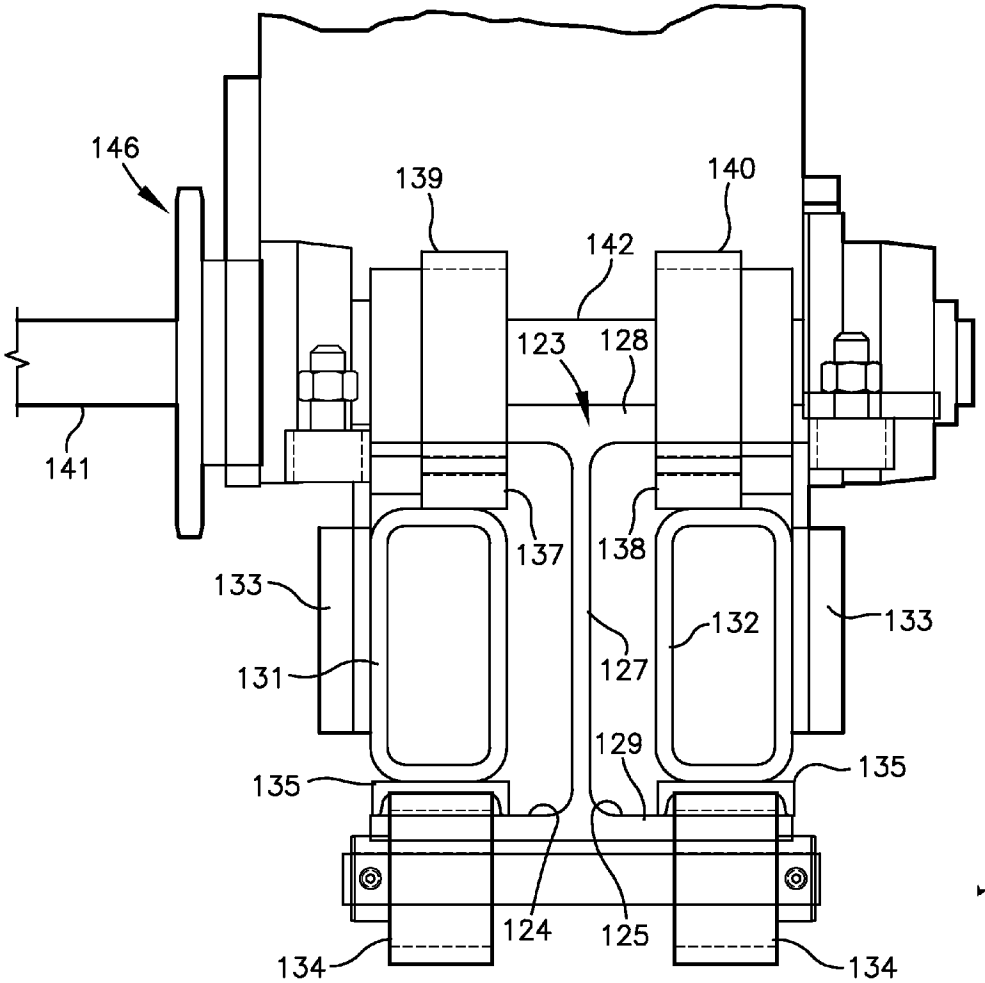
FIG. 11 is a greatly enlarged and fragmentary side view of a laterally telescoping beam assembly forming part of the laterally telescoping saw and track support frame as shown from an end in FIG. 6.
Figure 12:
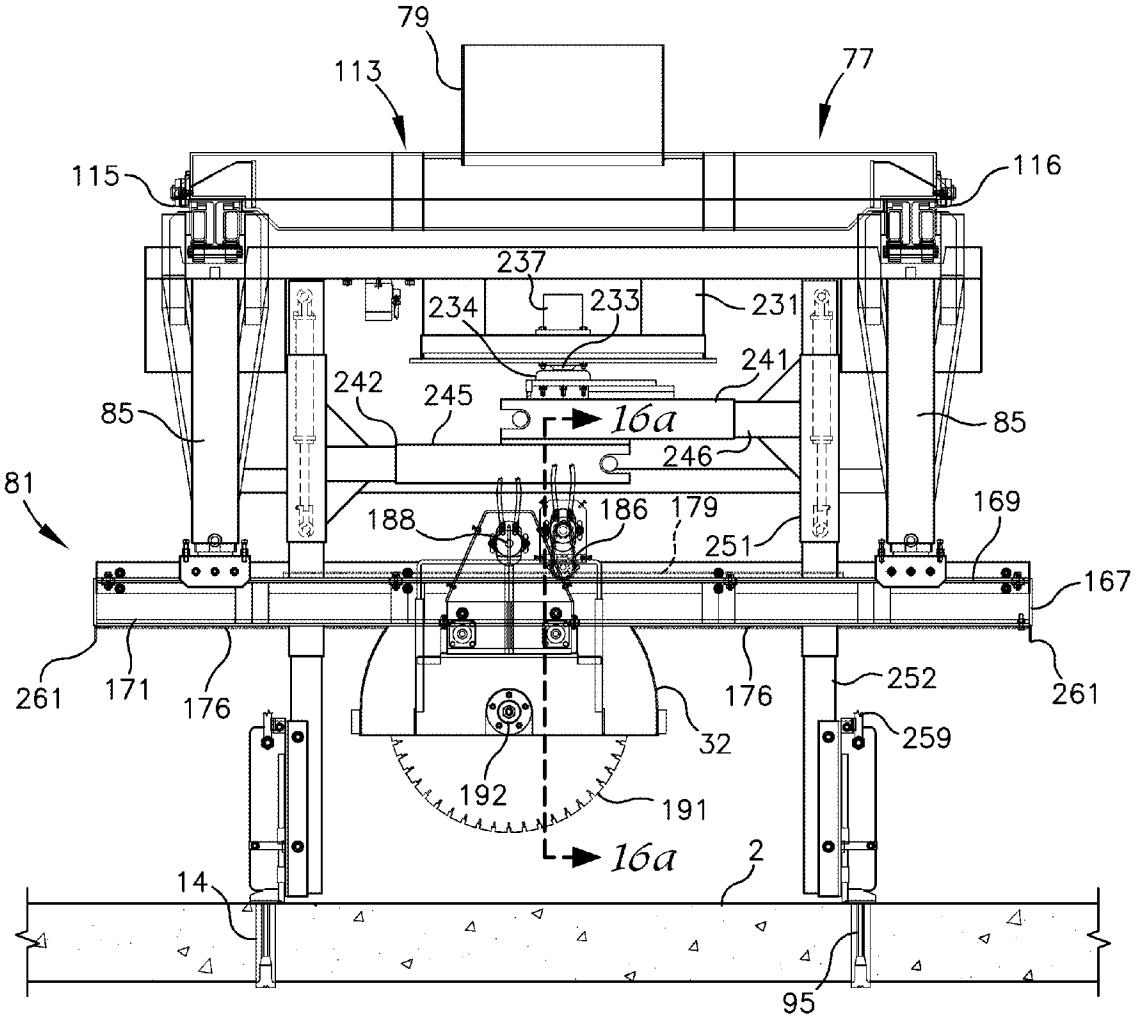
FIG. 12 is a side elevational view of the saw and drill assembly shown in spaced relationship over a paved slab similar to FIG. 6 showing the saw guide track retracted and the drill support assemblies extended with drill bits for the drills drilled into the paved slab.
Figure 13:
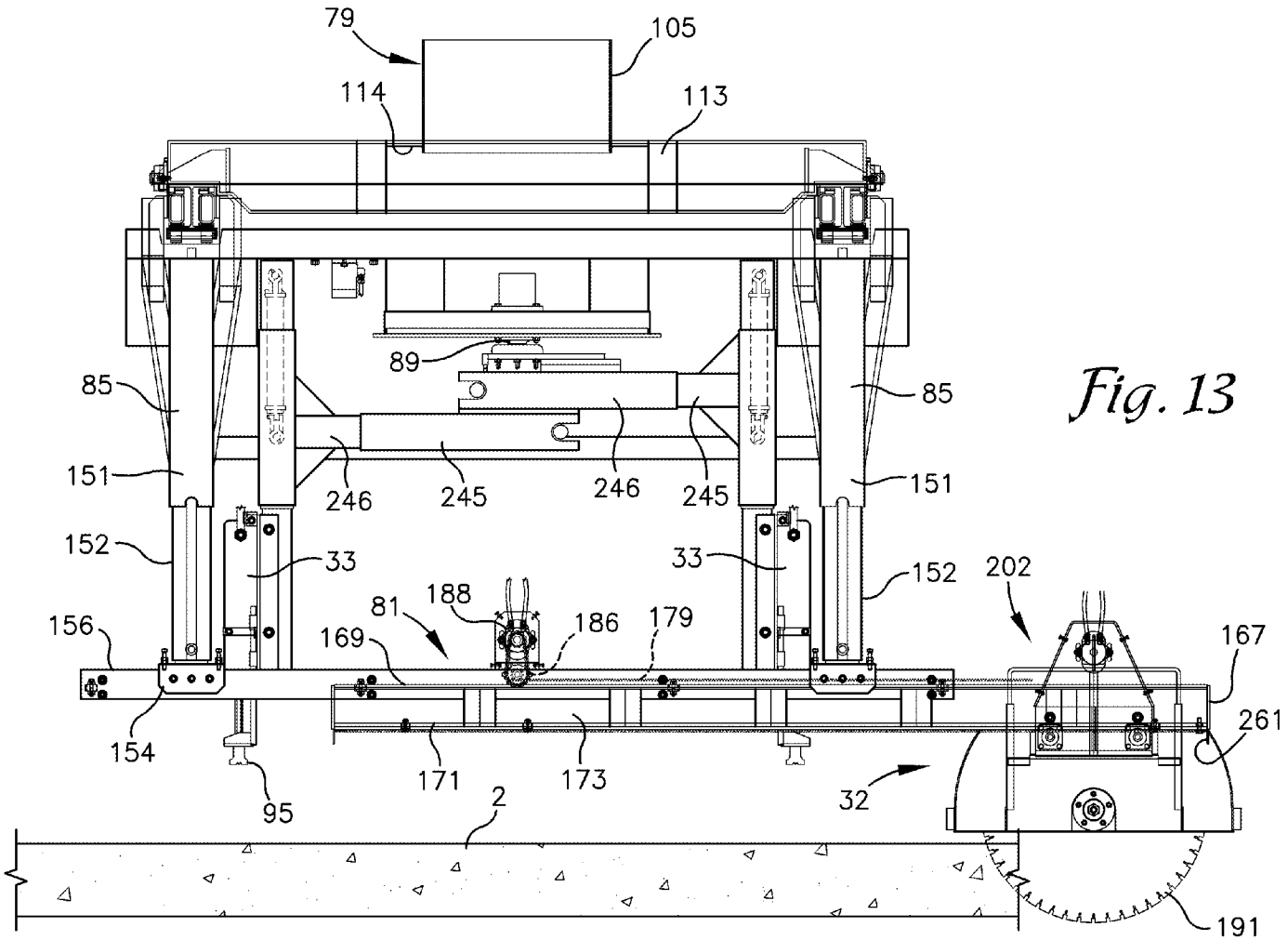
FIG. 13 is a side elevational view of the saw and drill assembly shown in spaced relationship over a paved slab similar to FIG. 6 showing the drill support assemblies retracted and telescoping track support legs supporting the saw guide track extended to advance the saw blade into engagement with the paved slab and showing a telescoping track beam of the track extended from a saw track base member to extend the length of the cut made by the saw blade.
Figure 14:
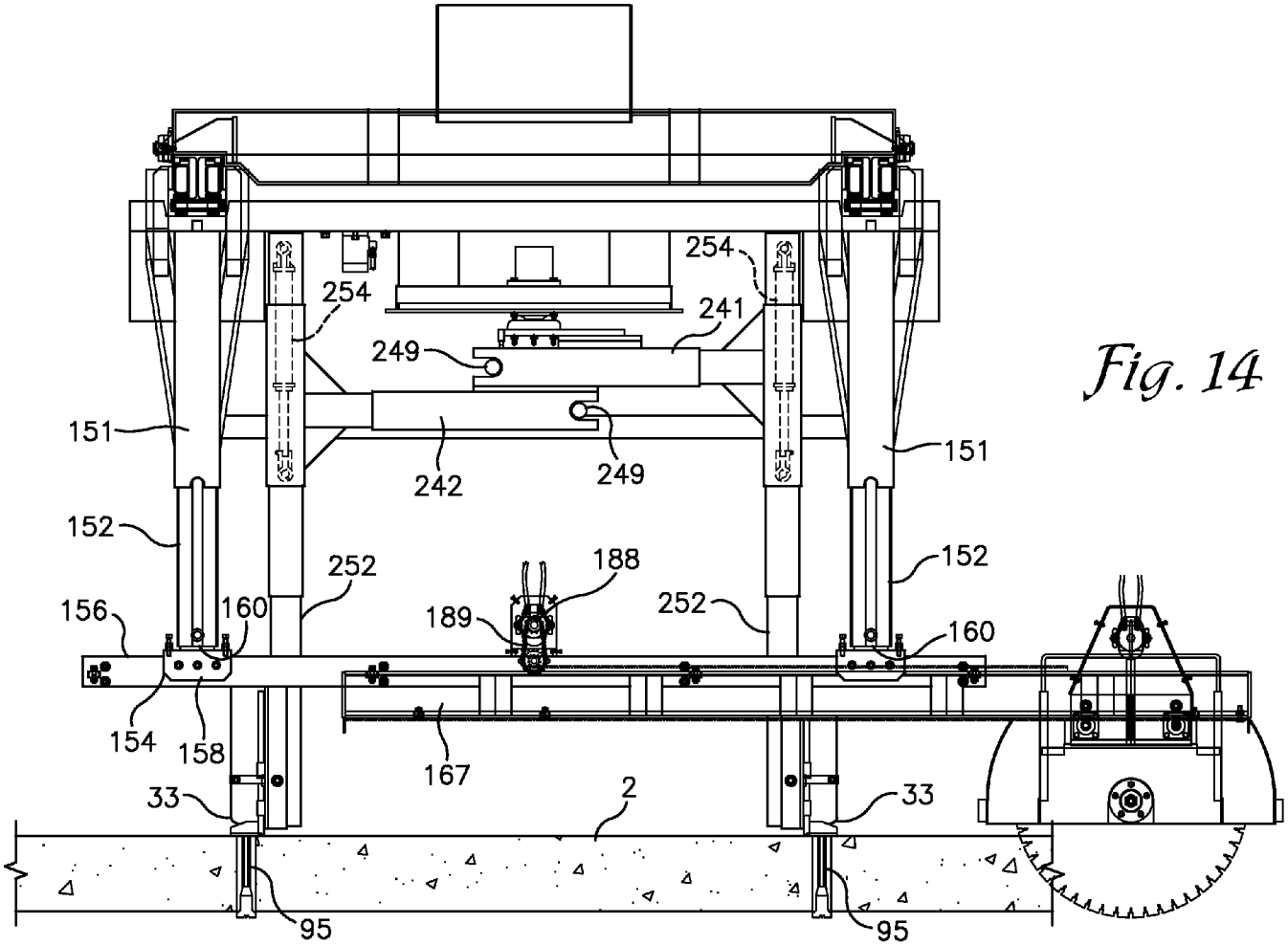
FIG. 14 is a side elevational view of the saw and drill assembly similar to FIG. 13 but showing the drill support assemblies extended demonstrating simultaneous cutting with the saw blades and drilling with the drill bits.

In use, an operator tows the mobile saw and drill 21 with a tractor 25 or the like to a section of a lane 3 of a slab 2 needing repair. During towing, the various assemblies described above are generally maintained in a retracted orientation. The inner tubes 51 and 61 of the rear and front legs 45 and 46 respectively of the mobile base frame or main frame 23 are retracted so that the weight of the mobile base frame 23 is supported on the trailer support wheels 41. The inner and outer telescoping beams 131 and 132 of the telescoping beam assemblies 115 and 116 from which the saw track support beams 119 and 120 are suspended are retracted so that the saw track support beams 119 and 120 are retracted relative to one another and as shown in FIG. 9.

The upper pivot assembly 79 is rotated so that the saw track support beams are generally oriented parallel to the direction of travel of the main frame 23. Similarly the lower pivot assembly 89 is rotated so that the laterally telescoping arms 241 and 242 which support drills 33 are oriented in axial alignment with the direction of travel of the main frame 23 and the arms 241 and 242 are preferably retracted to pull the vertically telescoping drill support legs 93 inward. The vertically telescoping drill support legs 93 are retracted to raise the drills 33 above the slab 2 during transport. Similarly, the vertically telescoping track support legs 85 are retracted to raise the saw drive track assemblies 81 and attached saw assemblies 82 and saws 32 above the slab 2 during movement of the main frame 23 to a work site.

Once the work site is reached, the mobile saw and drill 21 may be disconnected from the tractor 25 and the drive wheels 54 on the rear legs 45 of central frame assembly 27 are operated to move the mobile saw and drill 21 in position for use. To make cuts in the slab running longitudinally along the sides of the lane 3 between the lane 3 on which the mobile saw and drill 21 is positioned and the adjacent lane 3 and the shoulder 7, the inner and outer telescoping beams 131 and 132 of telescoping beam assemblies 115 and 116 are extended to extend the saw drive track assemblies 81 and saws 32 mounted thereon in a desired spacing. A typical spacing for longitudinal cuts is twelve feet wide. The saw carriers 202 may be operably moved near one end of the telescoping saw track beams 167 of saw drive track assemblies 81 and the saw drive track assemblies 81 are lowered to position the saw blades 191 just above the slab 2 where the cuts are to be made. The saw drive track assemblies 81 are lowered by extending the track support legs 85.

Hydraulic motors 198 are then engaged to rotate saw blade 191 and the track support legs 85 are further extended to advance the rotating saw blades 191 into contact with the slab 2 to begin cutting. As cutting is occurring, hydraulic motors 217 are engaged to advance the saw carriers 202 along the respective saw track beam 167 a distance corresponding to the length of the cut to be made in the slab 2. If the length of the cuts to be made are longer than the saw track beams 167, the saw track beams 167 may be extended relative to the saw track base member 156 by engaging hydraulic motor 188 while the blades 191 are moving along the respective track beams 167. Stop plates 261 are welded to and depend from the ends of the saw track beams 167 to engage the carriers 202 and prevent them from advancing off the ends of the saw track beams 167. It is to be understood that an operator will typically make several passes with the saw 32 back and forth along the cut to cut a couple of inches through the slab 2 with each pass. With each pass, the track support legs 85 are extended further to lower the saw track beams 167 and saws 32 further into the slab 2.

Once the longitudinal cuts are made completely through the slab 2, the saw track beams 167 and attached saw carriers 202 and saws 32 are raised by retracting track support legs 85. The saw track beams 167 are then retracted relative to one another by retracting the inner and outer telescoping beams 131 and 132 of telescoping beam assemblies 115 and 116 to a spacing corresponding to the desired width of lateral cuts 11 to be made across the slab 2. Actuator 110 of upper pivot assembly 79 is then operated to rotate the upper pivot assembly ninety degrees to rotate the saw and drill assembly 31 ninety degrees so that the saw drive track assemblies 81 extend transverse to the direction of travel of the main frame 23. The saw drive track assemblies 81 are then lowered by extending support legs 85 and the cutting sawing operation is initiated as discussed previously with respect to the longitudinal cuts in the slab 2.

While either the longitudinal cuts or lateral cuts are being made, the drills 33 may be operated to bore the desired holes 14 in the slab 2. Hydraulic motor 237 for the lower pivot assembly 89 is operated to rotate the drill support assembly 87 and the laterally telescoping arms 241 and 242 are extended to position each vertically telescoping drill support legs 93 and the attached drills 33 over a spot in which a hole 14 is to be bored in the slab 2. The drill support legs 93 are then extended to advance the drill bits 95 into engagement with the slab 2 and compressed air is delivered to the drills 33 to initiate drilling. Once drilling is complete, the drill support legs 93 are retracted and the drills 33 can be repositioned as needed by rotating the drill support assembly 87 and extending or retracting laterally telescoping arms 241 and 242 to the extent necessary to position the drills 33 over the correct spots. It is to be understood that drilling and sawing preferably will occur simultaneously at least until one of the processes is completed which will typically be the drilling operation. In this manner, a single operator can make the required cuts and bore the required holes in considerably less time than it would take multiple operators to make the required cuts and then separately bore the required holes. It is also understood that the operation of the saws and drills could be automated to terminate the cutting and drilling operations when complete and to control the length of the cuts.

It is also understood that a second set of laterally expanding and vertically extendable saw guide tracks with attached saws could be incorporated into the machine offset from the first set of guide tracks and saws by ninety degrees and rotatable therewith about the main vertical axis with the first set of guide tracks and saws for simultaneously cutting a second set of spaced saw cuts. The second set of cuts offset ninety degrees from the first set.

It is to be understood that while certain forms of the present invention have been illustrated and described herein, it is not to be limited to the specific forms or arrangement of parts described and shown. As used in the claims, identification of an element with an indefinite article "a" or "an" or the phrase "at least one" is intended to cover any device assembly including one or more of the elements at issue. Similarly, references to first and second elements is not intended to limit the claims to such assemblies including only two of the elements, but rather is intended to cover two or more of the elements at issue. Only where limiting language such as "a single" or "only one" with reference to an element, is the language intended to be limited to one of the elements specified, or any other similarly limited number of elements.

What is claimed and desired to be secured by Letters Patent is as follows:

1. A machine for making saw cuts in a paved slab, the machine comprising:

a) a main frame;

b) a saw and track support frame suspended from the main frame and rotatable relative to said main frame about a common vertical axis;

c) first and second saw guide tracks suspended from said saw and track support frame and extending in parallel spaced relationship on opposite sides of the common vertical axis; said saw and track support frame laterally expandable in a direction transverse to a longitudinal axis of each of said first and second saw guide tracks and laterally relative to the common vertical axis about which said saw and track support frame rotates to adjust a lateral spacing between said first and second saw track guides relative to the common vertical axis; each of said first and second saw guide tracks suspended from said saw and track support frame by at least one vertically extendable track support operable to adjust a vertical spacing of said respective first or second saw guide track connected thereto relative to the paved slab;

d) first and second saws, each of said first and second saws mounted on a saw carriage which is moveably mounted on a respective first and second saw guide track and operably moveable along said respective first and second saw guide track linearly relative thereto; each of said first and second saws having a circular saw blade rotatably mounted on said saw carriage for rotation about an axis transverse to the direction of travel of said saw carriage on said respective first and second saw guide track.

2. The machine as in claim 1 wherein said saw and track support frame is rotatable at least ninety degrees relative to said main frame about the common vertical axis.

3. The machine as in claim 1 wherein said saw and track support frame is rotatable between at least ninety degrees and approximately one hundred and fifteen degrees relative to said main frame about the common vertical axis.

4. The machine as in claim 1 wherein said main frame is supported on a plurality of wheels including at least one drive wheel operable to move the main frame across the paved slab.

5. The machine as in claim 1 wherein each of said first and second saw guide tracks is adjustably mounted to said at least one vertically extendable track support to adjust the angle of the saw guide track relative to said vertically extendable track support and an angle of said circular saw blade of said saw mounted thereon relative to vertical.

6. The machine as in claim 1 further comprising means for angling the orientation of the axis of rotation of each circular saw blade relative to said vertically extendable track support on which said saw is mounted.

7. The machine as in claim 1 further comprising a drill mounted on a drill support assembly suspended from the saw and track support frame and rotatable relative to said saw and track support frame about the common vertical axis; said drill support assembly including a laterally extendable drill support extending transverse to the common vertical axis and a vertically extendable drill support connected to and extending transverse to said laterally extendable drill support; said drill mounted on said vertically extendable drill support and having a drill bit extending below said vertically extendable drill support; said vertically extendable drill support operable to advance said drill bit into and out of engagement with the paved slab.

8. The machine as in claim 7 wherein said drill support assembly is rotatable three hundred and sixty degrees relative to said saw and track support frame.

9. A machine for making saw cuts and boring holes in a paved slab, the machine comprising:

a) a main frame;

b) a saw and track support member suspended from the main frame and rotatable relative to said main frame about a vertical axis;

c) a saw guide track suspended from said saw and track support member by a vertically extendable track support operable to adjust a vertical spacing of said saw guide track relative to the paved slab;

d) a saw mounted on a saw carriage moveably mounted on said saw guide track and operably moveable along said saw guide track linearly relative thereto; and e) a drill support assembly suspended from the main frame and rotatable about the vertical axis; said drill support assembly including a laterally extendable support extending transverse to the vertical axis and a vertically extendable drill support connected to and extending transverse to said laterally extendable support; and f) a drill mounted on said vertically extendable drill support and having a drill bit extending below said vertically extendable drill support; said vertically extendable drill support operable to advance said drill bit extending therebelow into and out of engagement with the paved slab.

10. The machine as in claim 9 wherein said saw and drill support assembly is connected to said saw and track support member.

11. The machine as in claim 10 wherein said drill support assembly is rotatable three hundred and sixty degrees relative to said saw and track support member.

12. The machine as in claim 9 wherein said saw and track support member is rotatable at least ninety degrees relative to said main frame about the vertical axis.

13. The machine as in claim 9 wherein said main frame is supported on a plurality of wheels including at least one drive wheel operable to move the main frame across the paved slab.

14. The machine as in claim 9 wherein said saw guide track is adjustably mounted to said vertically extendable track support to adjust the angle of the saw guide track relative to said vertically extendable track support and the angle of said circular saw blade of said saw mounted thereon relative to vertical.

15. The machine as in claim 9 wherein said saw includes a circular saw blade and the machine further comprising means for angling the orientation of the axis of rotation of said circular saw blade relative to said vertically extendable track support on which said saw is mounted.

16. A machine for making saw cuts in a paved slab, the machine comprising:

a) a main frame;

b) a saw and track support frame suspended from the main frame and rotatable relative to said main frame about a vertical axis;

c) first and second saw guide tracks mounted on said saw and track support frame and extending in parallel spaced relationship on opposite sides of the vertical axis; said saw and track support frame laterally expandable in a direction transverse to a longitudinal axis of each of said first and second saw guide tracks to adjust a lateral spacing between said saw track guides; each of said first and second saw guide track mounted on said saw and track support frame by at least one vertically extendable track support operable to adjust a vertical spacing of said respective first and second saw guide track connected thereto relative to the paved slab;

d) first and second saws, each saw mounted on a saw carriage which is moveably mounted on a respective first and second saw guide track and operably moveable along said respective first and second saw guide track linearly relative thereto; each of said first and second saws having a circular saw blade rotatably mounted on said saw carriage for rotation about an axis transverse to the direction of travel of said saw carriage on said respective first and second saw guide track; and e) a-first and second drills mounted on first and second drill support assemblies respectively suspended from the saw and track support frame and rotatable relative to said saw and track support frame about the vertical axis; said first and second drill support assemblies each including a laterally extendable drill support extending transverse to the vertical axis and a vertically extendable drill support connected to and extending transverse to said laterally extendable drill support; each of said first and second drills mounted on a respective one of said vertically extendable drill supports and having a drill bit extending below said vertically extendable drill support; each said vertically extendable drill support operable to advance said drill bit extending therebelow into and out of engagement with the paved slab, wherein said drill support assembly on which said first and second drills are respectively mounted extend on opposite sides of the vertical axis.

17. The machine as in claim 16 wherein said saw and track support frame is rotatable at least ninety degrees relative to said main frame about the vertical axis.

18. The machine as in claim 16 wherein said saw and track support frame is rotatable between at least ninety degrees and approximately one hundred and fifteen degrees relative to said main frame about the vertical axis.

19. The machine as in claim 16 wherein said main frame is supported on a plurality of wheels including at least one drive wheel operable to move the main frame across the paved slab.

20. The machine as in claim 16 wherein each of said first and second saw guide tracks is adjustably mounted to said at least one vertically extendable track support to adjust an angle of the respective first and second saw guide track relative to said at least one vertically extendable track support and an angle of said circular saw blade of said saw mounted thereon relative to vertical.

21. The machine as in claim 16 further comprising means for angling the orientation of the axis of rotation of each saw blade relative to said at least one vertically extendable track support on which said saw is mounted.

22. The machine as in claim 16 wherein said drill support assembly is rotatable three hundred and sixty degrees relative to said saw and track support frame.

* * * * *